US005398660A

United States Patent [19]

Koyama et al.

[11] Patent Number: 5,398,660

[45] Date of Patent: Mar. 21, 1995

[54] FUEL VAPOR PURGING SYSTEM

[75] Inventors: Nobuhiko Koyama, Nagoya; Kazuto Maeda, Aichi; Yuzi Ishiguro, Toyohashi; Seiko Abe, Okazaki; Toshihiko Igashira, Toyokawa; Yasuyuki Sakakibara, Nishio; Shinichiro Kamohara, Kasaoka, all of Japan

[73] Assignees: Nippondenso Co., Kariya; Nippon Soken Inc., Nishio, Japan

[21] Appl. No.: 71,010

[22] Filed: Jun. 2, 1993

[30] Foreign Application Priority Data

| | | | |
|---|---|---|---|
| Jun. 3, 1992 | [JP] | Japan | 4-142878 |
| Mar. 22, 1993 | [JP] | Japan | 5-061789 |
| May 28, 1993 | [JP] | Japan | 5-127259 |

[51] Int. Cl.[6] ..... F02M 25/08

[52] U.S. Cl. ..... 123/519; 123/520

[58] Field of Search ..... 123/519, 520; 95/268, 95/901; 96/152

[56] References Cited

U.S. PATENT DOCUMENTS

| | | | |
|---|---|---|---|
| 3,722,189 | 3/1973 | Tourtellotte | 55/389 |
| 4,058,380 | 11/1977 | King, II | 123/519 |
| 4,308,840 | 1/1982 | Hiramatsu et al. | 123/519 |
| 4,386,947 | 6/1983 | Mizuno et al. | 55/387 |
| 4,403,587 | 9/1983 | Mizuno et al. | 123/519 |
| 4,448,594 | 5/1984 | Kozawa | 123/519 |
| 4,581,047 | 4/1986 | Larsson | 55/179 |
| 4,658,796 | 4/1987 | Yoshida et al. | 123/519 |
| 4,717,401 | 1/1988 | Lupoli et al. | 55/208 |
| 4,758,255 | 7/1988 | Yamada et al. | 123/519 |
| 4,894,072 | 1/1990 | Turner et al. | 123/519 |
| 4,951,643 | 8/1990 | Sato et al. | 123/519 |
| 4,986,840 | 1/1991 | Mori et al. | 123/519 |
| 5,002,596 | 3/1991 | Moskaitis et al. | 96/152 |
| 5,060,620 | 10/1991 | Oslapas | 123/519 |
| 5,118,329 | 6/1992 | Kosaka et al. | 95/901 |
| 5,119,791 | 6/1992 | Gifford et al. | 123/519 |
| 5,170,765 | 12/1992 | Hoshino et al. | 123/519 |
| 5,173,095 | 12/1992 | Yasukawa et al. | 123/519 |
| 5,253,629 | 10/1993 | Fornuto et al. | 123/519 |
| 5,286,282 | 2/1994 | Goodell et al. | 96/152 |

FOREIGN PATENT DOCUMENTS

| | | |
|---|---|---|
| 53-77923 | 7/1978 | Japan . |
| 55-107057 | 8/1980 | Japan . |
| 60-127465 | 8/1985 | Japan . |

*Primary Examiner*—Raymond A. Nelli
*Assistant Examiner*—Thomas N. Moulis
*Attorney, Agent, or Firm*—Cushman, Darby & Cushman

[57] ABSTRACT

A fuel vapor purging system includes a container in which a set of divided chambers are formed by partition walls. Absorbent is disposed in the divided chambers. The divided chambers are sequentially connected to form a zigzag passage. Fuel vapor can enter the container from a fuel tank via a vapor line connecting the fuel tank and the container. In the container, an end of the vapor line faces the divided chamber which occupies an end of the set of the divided chambers. In the container, the fuel vapor is absorbed by the absorbent. Air can escape from the container via an opening in the container. The fuel vapor can be separated from the absorbent. The separated fuel vapor can be drawn into a suitable drawing device such as an engine air induction device via a purge line connecting the container and the drawing device. Fresh air can flow into the container via an air inlet provided on the container. Among the divided chambers, at least the divided chamber which occupies the end of the set of the divided chambers has a cross-sectional area equal to or smaller than 40 cm$^2$.

10 Claims, 13 Drawing Sheets

FUEL VAPOR PURGING SYSTEM

BACKGROUND OF THE INVENTION

1. Field of the Invention

This invention relates to a fuel vapor purging system for an automotive vehicle or others.

2. Description of the Prior Art

In automotive vehicles, fuel vapor tends to occur in a fuel tank. For automotive emission control, it is necessary to prevent such fuel vapor from leaking to the atmosphere. Some fuel vapor purging systems for automotive vehicles include a charcoal canister which absorbs fuel vapor transmitted from a fuel tank. During certain conditions, the fuel vapor is drawn from the canister into an air intake section of an automotive engine.

Japanese published unexamined utility model application 60-127465 discloses a charcoal canister which has a plurality of absorption chambers filled with activated charcoal. In Japanese application 60-127465, the charcoal canister has a vapor inlet successively followed by the absorption chambers, and the vapor inlet is connected to a fuel tank. In addition, the canister has a purge outlet connected to an engine air induction passage via a check valve.

In Japanese application 60-127465, during a fuel vapor absorbing process, fuel vapor flows from the tank into the canister via the vapor inlet. Then, the fuel vapor successively flows through the absorption chambers while being absorbed by the charcoal therein. The absorption chambers are arranged into a configuration which provides a long distance of a path of the flow of the fuel vapor in the charcoal to attain an adequate efficiency of the absorption of the fuel vapor by the charcoal.

In Japanese application 60-127465, during a vapor separating process, the check valve is opened so that the purge outlet of the canister is moved into communication with the engine air induction passage. Thus, the interior of the canister is subjected to a negative pressure, that is, an engine air induction vacuum. As a result of the vacuum, the fuel vapor is separated from the charcoal in the canister and is then purged via the purge outlet into the engine air induction passage. The canister also has an air inlet. During the vapor separating process, fresh air is introduced into the canister via an air inlet and is then drawn into the engine air induction passage together with the fuel vapor. The introduction of fresh air into the canister reduces a pressure loss in the canister and promotes the separation of the fuel vapor from the charcoal.

It is now assumed that an automotive vehicle equipped with such a fuel vapor purging system remains left without activating an engine for several days. During the daytime, the atmospheric temperature is usually high so that fuel evaporates in the fuel tank. The resultant fuel vapor is absorbed by the charcoal in the canister. During the night, the atmospheric temperature is usually low so that a vacuum occurs in the fuel tank. As a result of the vacuum, the fuel vapor is separated from the charcoal in the canister and is then returned via the vapor inlet to the fuel tank. In addition, air is introduced into the canister via the air inlet and is then moved toward the fuel tank together with the fuel vapor. Thus, the absorption of the fuel vapor by the canister and the return of the fuel vapor from the canister to the fuel tank are alternately repeated several times. In cases where the amount of the fuel vapor returned to the fuel tank is small, the charcoal in the canister tends to be saturated and hence the fuel vapor overflows from the canister via the air inlet during the daytime. Accordingly, a great amount of the fuel vapor returned to the fuel tank is desirable for automotive emission control.

SUMMARY OF THE INVENTION

It is an object of this invention to provide an improved fuel vapor purging system.

A first aspect of this invention provides a fuel vapor purging system comprising a container having a space therein; partition members for forming a plurality of divided chambers in the space; absorbent provided in each of the divided chambers; communication passages formed in the partition members for connecting the divided chambers which neighbor each other; a fuel vapor storing portion provided outside the container and storing fuel vapor; a fuel vapor introduction aperture formed in a part of the container which faces a divided chamber at a first end of a set of the divided chambers; a fuel vapor passage for connecting the fuel vapor introduction aperture and the fuel vapor storing portion; an atmosphere aperture opening into an atmosphere and formed in a part of the container which faces a divided chamber at a second end of the set of the divided chambers; a first opening formed in a part of the container which faces one ends of the divided chambers with respect to longitudinal directions of the divided chambers; an atmosphere introduction passage for connecting the first opening and the atmosphere; a fuel vapor drawing portion provided outside the container for drawing fuel vapor thereinto; a second opening formed in a part of the container which faces other ends of the divided chambers with respect to the longitudinal directions of the divided chambers; a fuel vapor drawing passage for connecting the second opening and the fuel vapor drawing portion; atmosphere introduction passage closing and opening means provided in the atmosphere introduction passage for closing and opening the atmosphere introduction passage; fuel vapor drawing passage closing and opening means provided in the fuel vapor drawing passage for closing and opening the fuel vapor drawing passage; and control means for outputting a control signal to close the atmosphere introduction passage closing and opening means and the fuel vapor drawing passage closing and opening means when fuel vapor is to be absorbed by the absorbent, and for outputting a control signal to open the atmosphere introduction passage closing and opening means and the fuel vapor drawing passage closing and opening means when fuel vapor is to be separated from the absorbent; wherein the communication passages are formed alternately up and down from the divided chamber at the first end of the set of the divided chambers to the divided chamber at the second end of the set of the divided chambers; and wherein, among the divided chambers, at least the divided chamber at the first end of the set of the divided chambers has a flow-path cross-sectional area equal to or smaller than 40 $cm^2$.

A second aspect of this invention provides a canister in a fuel vapor purging system which comprises means for defining a chamber through which fluid can flow; and absorbent disposed in the chamber; wherein the chamber has a cross-sectional area of 40 $cm^2$ or smaller with respect to a flow of fluid.

DESCRIPTION OF THE FIRST PREFERRED EMBODIMENT

Figure 1:
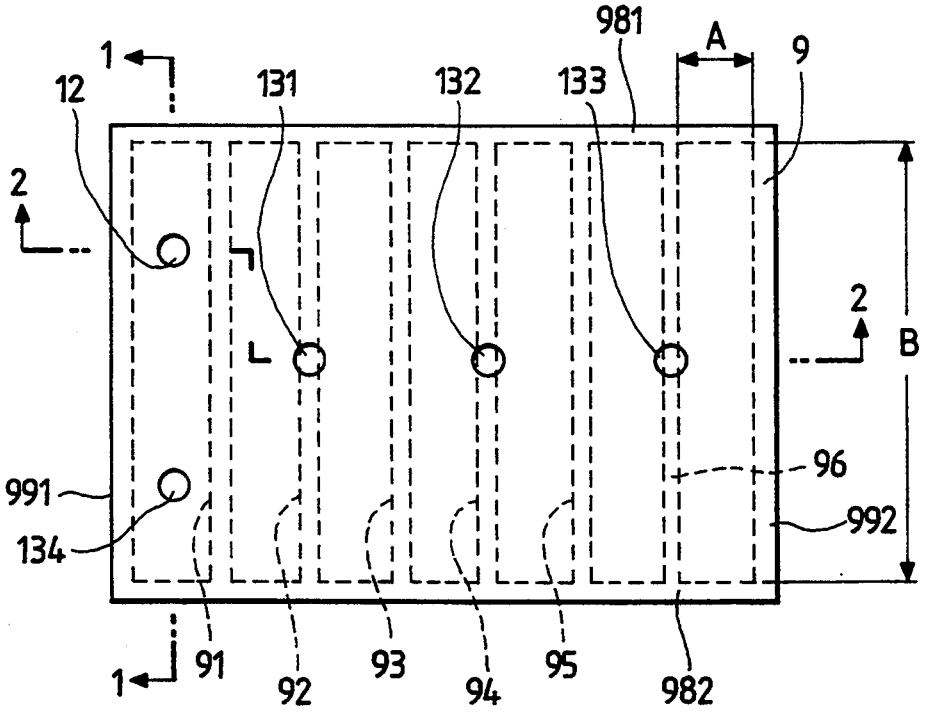
FIG. 1 is a top view of a canister casing in a fuel vapor purging system according to a first embodiment of this invention.
Figure 2:
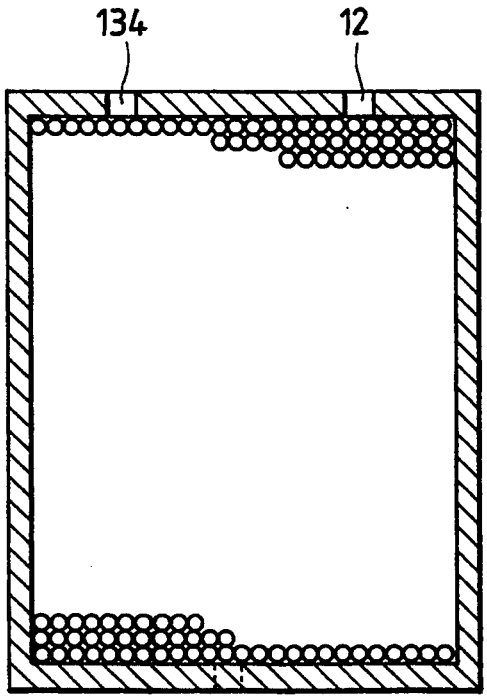
FIG. 2 is a sectional view taken along the line 1—1 of FIG. 1.
Figure 3:
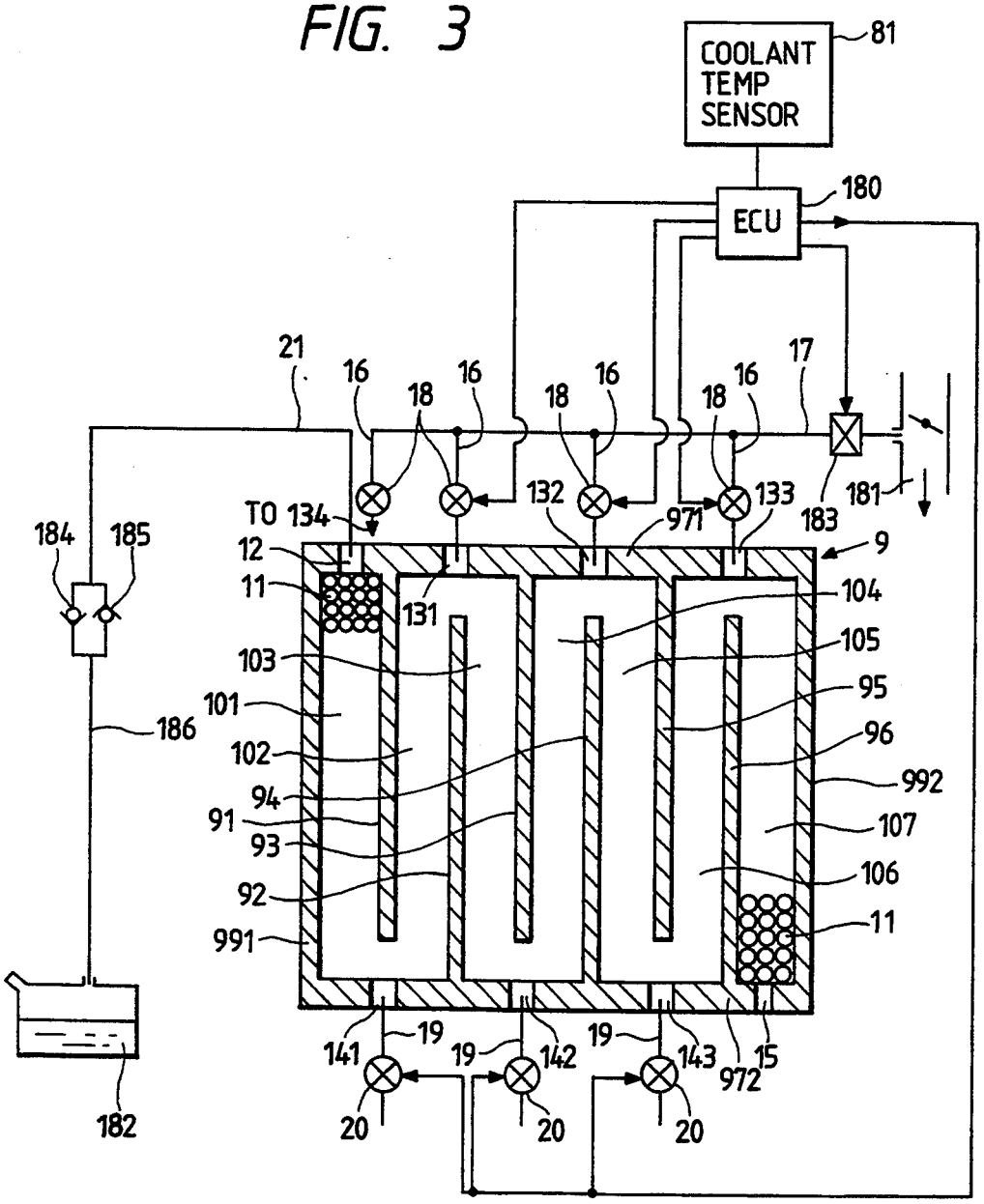
FIG. 3 is a diagram of the fuel vapor purging system in the first embodiment which includes a sectional view taken along the line 2—2 of FIG. 1.

With reference to FIGS. 1-3, a canister has a box-shaped casing 9. Fins 91, 93, and 95 provided in the casing 9 divide the interior of the casing 9. The fins 91, 93, and 95 extend from an upper portion 971 of the casing 9 toward a lower portion 972 thereof. In addition, fins 92, 94, and 96 provided in the casing 9 divide the interior of the casing 9. The fins 92, 94, and 96 extend from the lower portion 972 of the casing 9 toward the upper portion 971 thereof. As shown in FIG. 1, the fins 91-96 extend between opposite side portions 981 and 982 of the casing 9.

The fins 91-96 are partition walls which separate the interior of the casing 9 into seven layer-shaped chambers 101-107 connected in series via upper or lower communication openings. The layer-shaped chambers (divided chambers) 101-107 form a zigzag passage (path) extending alternately upward and downward. The upper communication openings for connecting the layer-shaped chambers 102-107 are spaces between the upper edges of the fins 92, 94, and 96 and the upper portion 971 of the casing 9. The lower communication openings for connecting the layer-shaped chambers 101-106 are spaces between the lower edges of the fins 91, 93, and 95 and the lower portion 972 of the casing 9.

The fins 91-96 and opposite side portions 991 and 992 of the casing 9 are spaced in parallel at equal intervals. Thus, the layer-shaped chambers 101-107 have approximately equal cross-sectional areas. For example, the cross-sectional area of each of the layer-shaped chambers 101-107 has dimensions "A" and "B" (see FIG. 1) equal to about 2.0 cm and 10.0 cm respectively, and thus the cross-sectional area is equal to about 20 $cm^2$. The layer-shaped chambers 101-107 are filled with absorbent 11 such as activated charcoal.

The upper portion 971 of the casing 9 has five circular apertures 12, 131, 132, 133, and 134. The aperture 12 which faces the layer-shaped chamber 101 forms a canister vapor inlet connected to a fuel tank 182 via vapor lines 21 and 186 and check valves 184 and 185. Fuel vapor can flow from the fuel tank 182 into the layer-shaped chamber 101 via the vapor lines 21 and 186, the check valve 184, and the vapor inlet 12. The aperture 134 which faces the layer-shaped chamber 101 and the apertures 131, 132, and 133 which face the fins 92, 94, and 96 are canister purge outlets connected via purge passages 16 and 17 to the region of an engine air induction passage 181 downstream of a throttle valve (no reference numeral). Fuel vapor separated from the charcoal 11 can be drawn into the engine air induction passage 181 via the purge outlets 131-134 and the purge passages 16 and 17. The purge passages 16 which extend from the purge outlets 131-134 are combined into a single line forming the purge passage 17 leading to the engine air induction passage 181. A purge control valve 183 including an electrically-driven valve is provided in the purge passage 17.

The lower portion 972 of the casing 9 has four circular apertures 141, 142, 143, and 15. The apertures 141, 142, and 143 which face the fins 91, 93, and 95 are canister air inlets connected to the atmosphere via air introduction passages 19 respectively. Fresh air can be introduced into the casing 9 via the air introduction passages 19 and the air inlets 141, 142, and 143. The aperture 15 which faces the layer-shaped chamber 107 forms a canister air inlet opening into the atmosphere. Fresh air can be introduced into the layer-shaped chamber 107 via the air inlet 15.

Electrically-driven valves or solenoid valves 18 are provided in the purge passages 16 respectively. The valves 18 selectively block and unblock the purge passages 16 in response to control signals fed from an electronic control unit (ECU) 180. Electrically-driven valves or solenoid valves 20 are provided in the air introduction passages 19 respectively. The valves 20 selectively block and unblock the air introduction passages 19 in response to control signals fed from the ECU 180.

A sensor 81 detects the temperature of engine coolant. The output signal of the temperature sensor 81 is applied to the ECU 180.

The inner surfaces of the casing 9 are provided with suitable members (not shown) which prevent the leakage of the charcoal 11 from the casing 9 via the vapor inlet 12, the purge outlets 131–134, and the air inlets 15 and 141–143.

Figure 4:
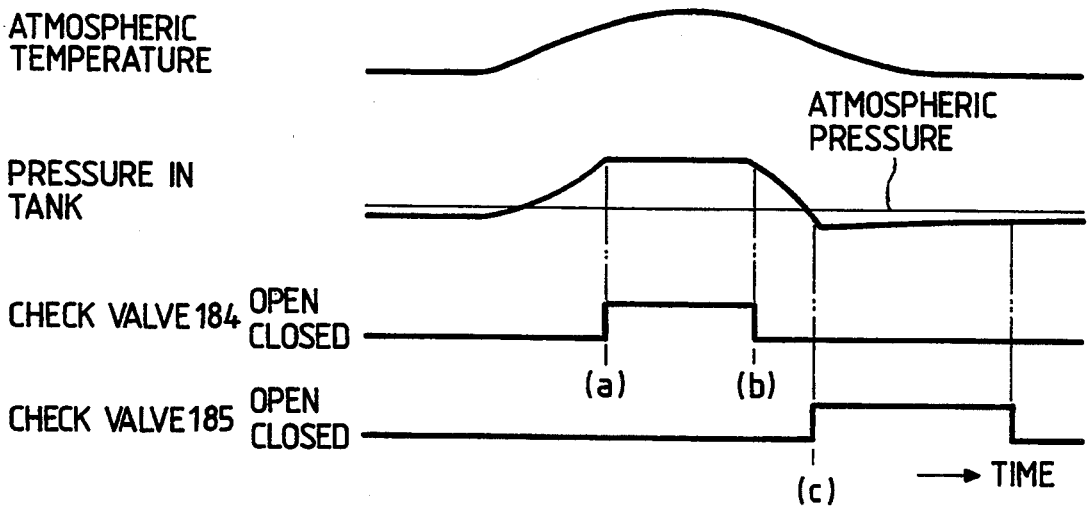
FIG. 4 is a time-domain diagram of the atmospheric pressure, the pressure in a fuel tank, and the states of check valves in the fuel vapor purging system in the first embodiment.

It is now assumed that, as shown in FIG. 4, the atmospheric temperature rises and thus the pressure within the fuel tank 182 increases during suspension of the engine. When the pressure within the fuel tank 182 exceeds the atmospheric pressure by a predetermined pressure value (equal to, for example, 22 mmHg), the check valve 184 is opened so that fuel vapor flows from the fuel tank 182 into the layer-shaped chamber 101 of the canister via the vapor lines 186 and 21 and the vapor inlet 12. At this time, the valves 18 and 20 continue to block the purge passages 16 and the air introduction passages 19 in response to the control signals from the ECU 180. Thus, the fuel vapor successively flows in the layer-shaped chambers 101–107 while being absorbed by the charcoal 11 therein. During this process, air can escape from the interior of the casing 9 via the air inlet 15.

It is now assumed that, as shown in FIG. 4, the atmospheric temperature drops and thus the pressure within the fuel tank 182 decreases during suspension of the engine. As the pressure within the fuel tank 182 drops, the check valve 184 closes so that the flow of the fuel vapor from the fuel tank into the canister is interrupted. When the pressure within the fuel tank 182 drops below the atmospheric pressure by a predetermined pressure value (equal to, for example, 10 mmHg), the check valve 185 is opened so that a vacuum is applied from the fuel tank 182 to the canister. As a result of the application of the vacuum, the fuel vapor is separated from the charcoal 11 in the canister and is then returned to the fuel tank 182 via the vapor lines 186 and 21 and the vapor inlet 12. It should be noted that the valves 18 and 20 continue to block the purge passages 16 and the air introduction passages 19 in response to the control signals from the ECU 180. At this time, air is introduced into the canister via the air inlet 15 and is then moved toward the fuel tank 182 together with the fuel vapor. It was experimentally confirmed that the rate of the air flow into the canister was equal to a small rate, for example, one liter per hour.

Figure 6:
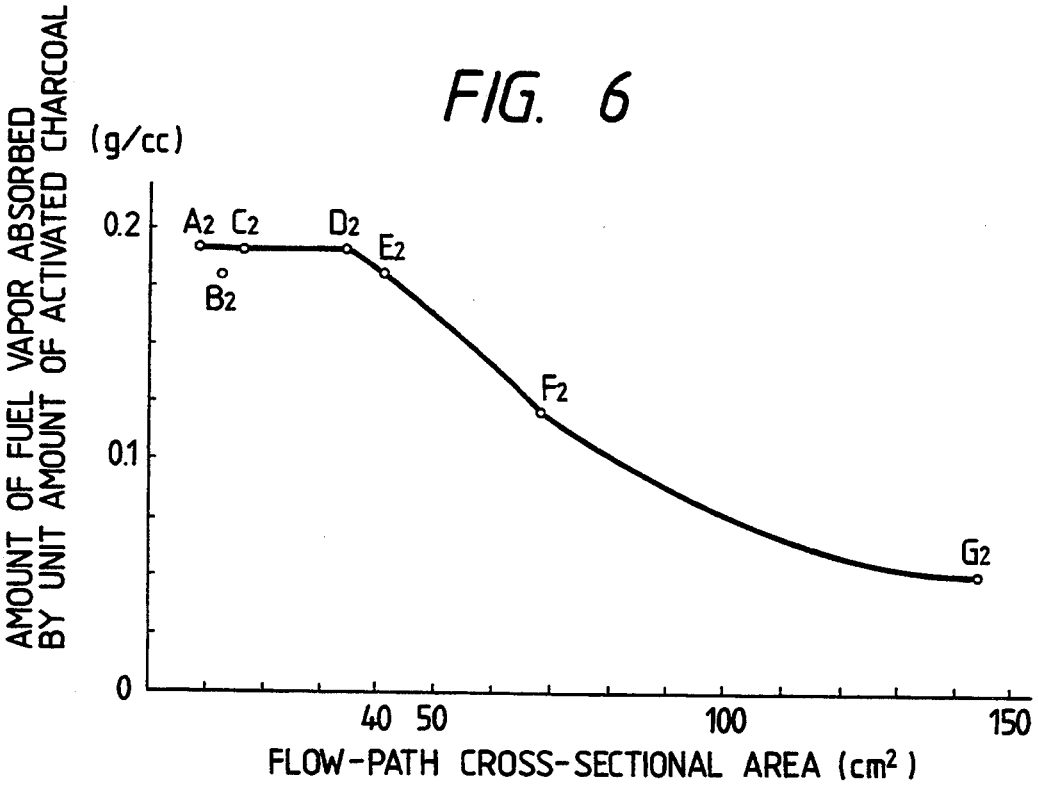
FIG. 6 is a diagram of the relation between the amount of fuel vapor absorbed by a unit amount of charcoal and the cross-sectional area of divided chambers in a canister.

Experiments were performed on the relation between the amount of fuel vapor absorbed by a unit amount of the charcoal 11 and the cross-sectional area of the layer-shaped chambers 101–107 in the canister. During the experiments, the temperature at a region around the canister was held at 40° C.+1.5° C. Various samples of the canister were prepared which had different cross-sectional areas of the layer-shaped chambers 101–107. The amount of fuel vapor absorbed by a unit amount of the charcoal 11 was measured for each of the samples of the canister. FIG. 6 shows the results of the measurement. In FIG. 6, points A2–G2 denote the measurement results. At the point A2, the amount of absorbed fuel vapor was 0.19 g/cc while the cross-sectional area of the layer-shaped chambers 101–107 was 9.0 $cm^2$. At the point B2, the amount of absorbed fuel vapor was 0.18 g/cc while the cross-sectional area of the layer-shaped chambers 101–107 was 12.6 $cm^2$. At the point C2, the amount of absorbed fuel vapor was 0.19 g/cc while the cross-sectional area of the layer-shaped chambers 101–107 was 16.2 $cm^2$. At the point D2, the amount of absorbed fuel vapor was 0.19 g/cc while the cross-sectional area of the layer-shaped chambers 101–107 was 34.2 $cm^2$. At the point E2, the amount of absorbed fuel vapor was 0.18 g/cc while the cross-sectional area of the layer-shaped chambers 101–107 was 41.0 $cm^2$. At the point F2, the amount of absorbed fuel vapor was 0.12 g/cc while the cross-sectional area of the layer-shaped chambers 101–107 was 68.4 $cm^2$. At the point G2, the amount of absorbed fuel vapor was 0.05 g/cc while the cross-sectional area of the layer-shaped chambers 101–107 was 144.0 $cm^2$. It was understood from the results of the measurement that the amount of absorbed fuel vapor was sufficiently great when the cross-sectional area of the layer-shaped chambers 101–107 was equal to or smaller than about 40 $cm^2$. Thus, it is preferable that the cross-sectional area of the layer-shaped chambers 101–107 is equal to or smaller than about 40 $cm^2$. As previously described, in this embodiment, the cross-sectional area of the layer-shaped chambers 101–107 is set to, for example, about 20 $cm^2$.

After the fuel vapor is absorbed by an area of the charcoal 11, the fuel vapor tends to diffuse from this area to neighboring areas of the charcoal 11. Such diffusion of the fuel vapor results in a leakage of the fuel vapor from the canister via the air inlet 15. Thus, it is desirable to reduce the mount of diffused fuel vapor.

Figure 7:
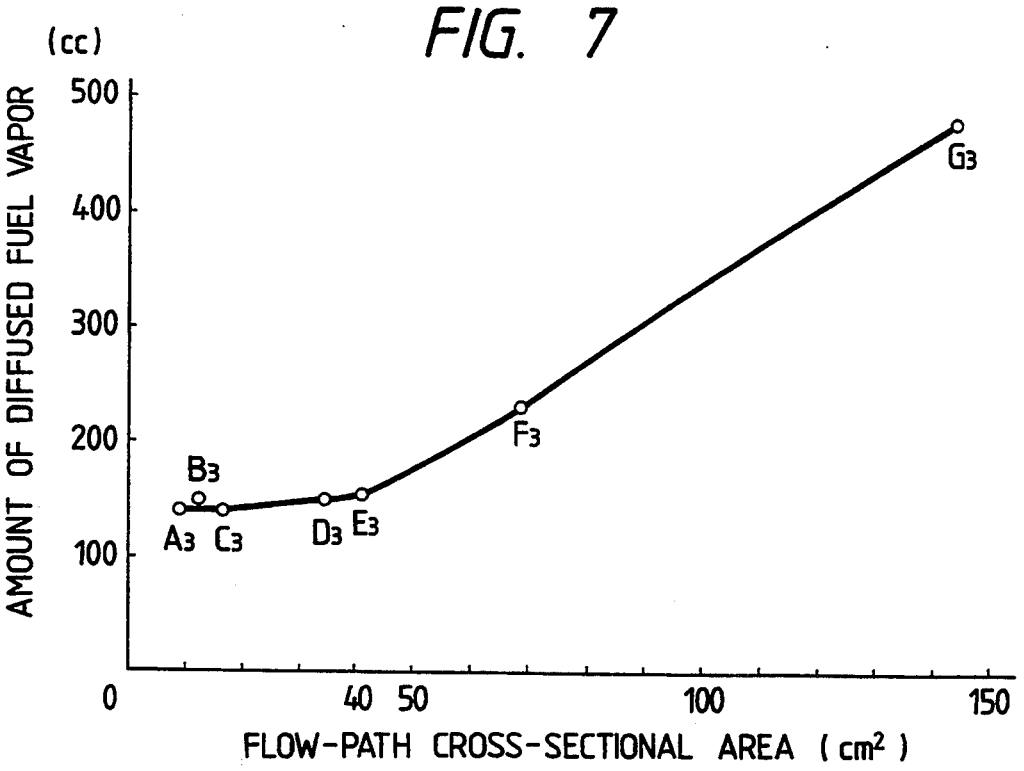
FIG. 7 is a diagram of the relation between the amount of diffused fuel vapor and the cross-sectional area of divided chambers in a canister.

Experiments were performed on the relation between the amount of diffused fuel vapor and the cross-sectional area of the layer-shaped chambers 101–107 in the canister. During the experiments, the temperature at a region around the canister was held at 40° C.+1.5° C. Various samples of the canister were prepared which had different cross-sectional areas of the layer-shaped chambers 101–107. The mount of diffused fuel vapor was measured for each of the samples of the canister. FIG. 7 shows the results of the measurement. In FIG. 7, points A3–G3 denote the measurement results. At the point A3, the amount of diffused fuel vapor was 140 cc while the cross-sectional area of the layer-shaped chambers 101–107 was 9.0 $cm^2$. At the point B3, the amount of diffused fuel vapor was 150 cc while the cross-sectional area of the layer-shaped chambers 101–107 was 12.6 $cm^2$. At the point C3, the amount of diffused fuel vapor was 140 cc while the cross-sectional area of the layer-shaped chambers 101–107 was 16.2 $cm^2$. At the point D3, the amount of diffused fuel vapor was 150 cc while the cross-sectional area of the layer-shaped chambers 101–107 was 34.2 $cm^2$. At the point E3, the amount of diffused fuel vapor was 155 cc while the cross-sectional area of the layer-shaped chambers 101–107 was 41.0 $cm^2$. At the point F3, the amount of diffused fuel vapor was 230 cc while the cross-sectional area of the layer-shaped chambers 101–107 was 68.4 $cm^2$. At the point G3, the amount of diffused fuel vapor was 475 cc while the cross-sectional area of the layer-shaped chambers 101–107 was 144.0 $cm^2$. It was understood from the results of the measurement that the amount of diffused fuel vapor was sufficiently small when the cross-sectional area of the layer-shaped chambers 101–107 was equal to or smaller than about 40 $cm^2$. Thus, it is preferable that the cross-sectional area of the layer-shaped chambers 101–107 is equal to or smaller than about 40 $cm^2$. As previously described, in this embodiment, the cross-sectional area of the layer-shaped chambers 101–107 is set to, for example, about 20 $cm^2$. A small amount of diffused fuel vapor results in effective prevention of the leakage of the fuel vapor from the canister via the air inlet 15.

Figure 5:
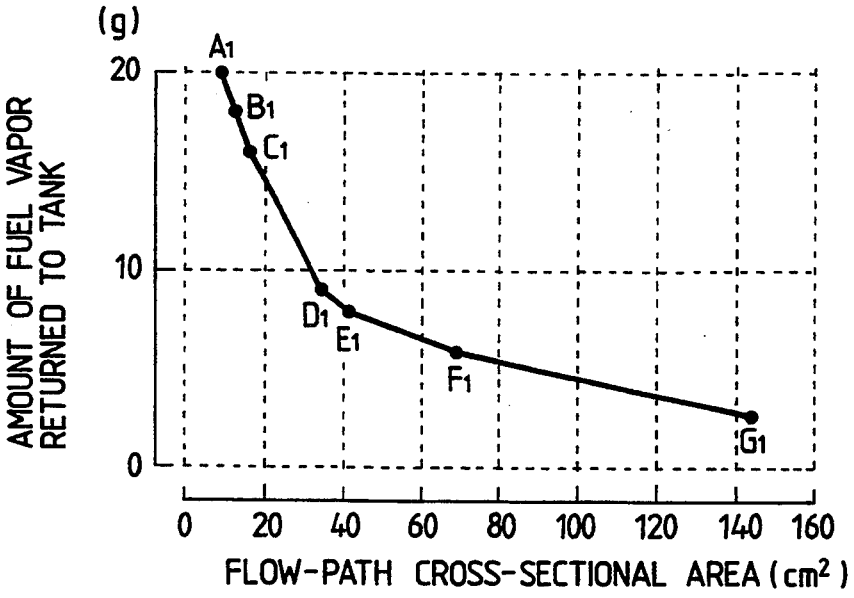
FIG. 5 is a diagram of the relation between the amount of fuel vapor returned to a fuel tank from a canister and the cross-sectional area of divided chambers in the canister.

As previously described, a great amount of the fuel vapor returned to the fuel tank 182 from the canister is desirable for automotive emission control. Experiments were performed on the relation between the amount of fuel vapor returned to the fuel tank 182 from the canister and the cross-sectional area of the layer-shaped chambers 101–107 in the canister. During the experiments, the temperature at a region around the canister was held at 40° C. ±1.5° C. Various samples of the canister were prepared which had different cross-sectional areas of the layer-shaped chambers 101–107. The amount of fuel vapor returned to the fuel tank 182 from the canister was measured for each of the samples of the canister. FIG. 5 shows the results of the measurement. In FIG. 5, points A1–G1 denote the measurement results. At the point A1, the amount of returned fuel vapor was 20 g while the cross-sectional area of the layer-shaped chambers 101–107 was 9.0 $cm^2$. At the point B1, the amount of returned fuel vapor was 18 g while the cross-sectional area of the layer-shaped chambers 101–107 was 12.6 $cm^2$. At the point C1, the amount of returned fuel vapor was 16 g while the cross-sectional area of the layer-shaped chambers 101–107 was 16.2 $cm^2$. At the point D1, the amount of returned fuel vapor was 9 g while the cross-sectional area of the layer-shaped chambers 101–107 was 34.2 $cm^2$. At the point E1, the amount of returned fuel vapor was 8 g while the cross-sectional area of the layer-shaped chambers 101–107 was 41.0 $cm^2$. At the point F1, the amount of returned fuel vapor was 6 g while the cross-sectional area of the layer-shaped chambers 101–107 was 68.4 $cm^2$. At the point G1, the mount of returned fuel vapor was 2 g while the cross-sectional area of the layer-shaped chambers 101–107 was 144.0 $cm^2$. It was understood from the results of the measurement that the amount of returned fuel vapor was great when the cross-sectional area of the layer-shaped chambers 101–107 was equal to or smaller than about 40 $cm^2$. Thus, it is preferable that the cross-sectional area of the layer-shaped chambers 101–107 is equal to or smaller than about 40 $cm^2$. It is most preferable that the cross-sectional area of the layer-shaped chambers 101–107 is equal to or smaller than about 20 $cm^2$. As previously described, in this embodiment, the cross-sectional area of the layer-shaped chambers 101–107 is set to, for example, about 20 $cm^2$.

The ECU 180 includes a microcomputer or a similar device which operates in accordance with a program stored in an internal ROM. The program is designed to execute the following operation of the ECU 180.

Figure 8:
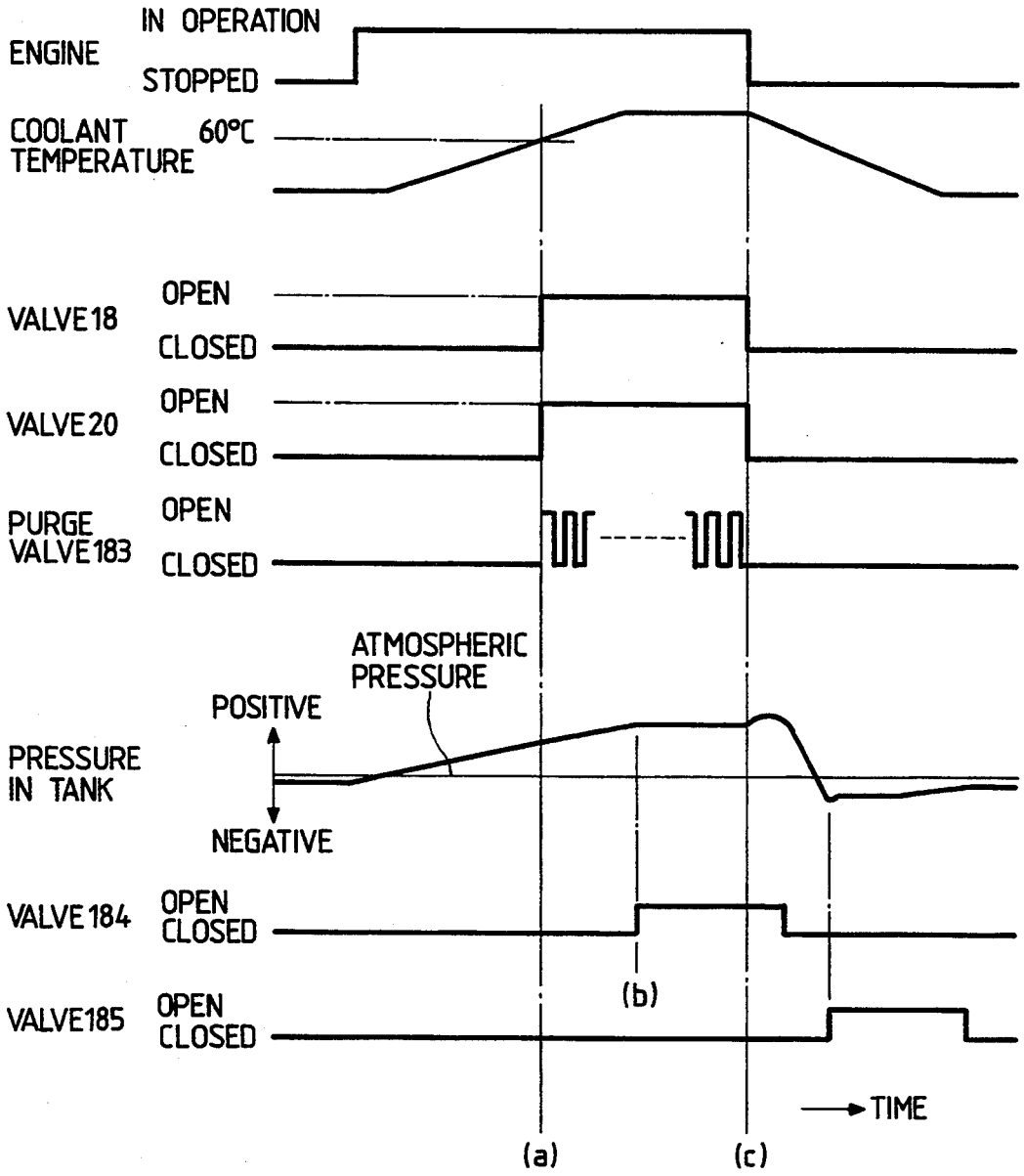
FIG. 8 is a time-domain diagram of the states of various valves, the state of an engine, the temperature of engine coolant, and the pressure in a fuel tank in the fuel vapor purging system in the first embodiment.

With reference to FIG. 8, the engine coolant temperature increases after the engine starts. When the engine coolant temperature represented by the output signal of the temperature sensor 81 exceeds a predetermined temperature (equal to, for example, 60° C.), the ECU 180 outputs control signals to the valves 18 and 20 to open them. In addition, the ECU 180 outputs a control pulse signal to the purge control valve 183 to open the latter. The ECU 180 has information of the air-to-fuel ratio of an air-fuel mixture drawn into the combustion chambers of the engine. The control pulse signal outputted to the purge control valve 183 has a duty factor which is adjusted by the ECU 180 in response to the air-to-fuel ratio of the air-fuel mixture. The time-averaged degree of opening of the purge control valve 183 depends on the duty cycle of the control pulse signal fed thereto. Thus, the degree of opening of the purge control valve 183 is controlled in accordance with the air-to-fuel ratio of the air-fuel mixture.

When the valves 18 and 183 are opened in response to the control signals fed from the ECU 180, a negative pressure (that is, an engine air induction vacuum) is applied to the interior of the caster via the purge passages 16 and 17 and the purge outlets 131–134. As a result of the application of the vacuum, fuel vapor is separated from the charcoal 11 in the canister and is then purged into the engine air induction passage 181 via the purge passages 16 and 17 and the purge outlets 131–134. In addition, the valves 20 are opened in response to the control signals fed from the ECU 180. Therefore, fresh air is introduced into the canister via the air introduction passages 19, and the air inlets 15 and 141–143. The fresh air flows through the charcoal 11 in the canister while promoting the separation of the fuel vapor from the charcoal 11. The fresh air exits from the canister via the purge outlets 131–134 before being drawn into the engine air induction passage 181 together with the fuel vapor. In the canister, the fresh air flows along seven different paths. The first flow path extends between the air inlet 141 and the purge outlet 134 via the layer-shaped chamber 101. The second flow path extends between the air inlet 141 and the purge outlet 131 via the layer-shaped chamber 102. The third flow path extends between the air inlet 142 and the purge outlet 131 via the layer-shaped chamber 103. The fourth flow path extends between the air inlet 142 and the purge outlet 132 via the layer-shaped chamber 104. The fifth flow path extends between the air inlet 143 and the purge outlet 132 via the layer-shaped chamber 105. The sixth flow path extends between the air inlet 143 and the purge outlet 133 via the layer-shaped chamber 106. The seventh flow path extends between the air inlet 15 and the purge outlet 133 via the layer-shaped chamber 107.

Under these conditions, when the temperature of fuel in the tank 182 increases and thus the pressure within the tank 182 exceeds the atmospheric pressure by a predetermined pressure value (equal to, for example, 22 mmHg), the check valve 184 is opened so that fuel vapor flows from the fuel tank 182 into the layer-shaped chamber 101 of the canister via the vapor lines 186 and 21 and the vapor inlet 12. The fuel vapor flows in the charcoal 11 in the layer-shaped chamber 101 while being temporarily absorbed thereby. The fuel vapor then exits from the layer-shaped chamber 101 via the purge outlet 134, being drawn into the engine air induction passage 181.

When the engine is stopped, all the valves 18, 20, and 183 close. In cases where all the valves 18, 20, and 183 are closed, the previously-mentioned fuel vapor absorbing process (see FIG. 4) and the previously-mentioned fuel vapor returning process (see FIG. 4) can occur.

As previously described, during the fuel vapor absorbing process, the fuel vapor successively flows in the layer-shaped chambers 101–107 which have a small cross-sectional area (equal to, for example, about 20 $cm^2$). Thus, the distribution of absorbed fuel vapor can be uniform over the whole region of the charcoal 11 in the canister, and the whole region of the charcoal 11 can be used and efficient absorption of fuel vapor can be attained. Therefore, a relatively small amount of the charcoal 11 suffices to absorb a desired amount of fuel vapor.

As previously described, the fuel vapor tends to diffuse in the charcoal 11. Such diffusion of the fuel vapor causes a leakage of the fuel vapor from the canister via the air inlet 15. Thus, it is desirable to reduce the mount of diffused fuel vapor. In this embodiment, since the cross-sectional area of the layer-shaped chambers 101–107 is chosen to sufficiently reduce the amount of diffused fuel vapor, the leakage of the fuel vapor from the canister via the air inlet 15 can be effectively suppressed.

During the purging process where the fuel vapor is separated from the charcoal 11 in the canister and is then drawn into the engine air induction passage 181, the separated fuel vapor and the fresh air flow along the seven different paths between the air inlets 15 and 141–143 and the purge outlets 131–134. Since the seven flow paths are relatively short, the efficiency of the separation of the fuel vapor from the charcoal 11 or the amount of the fuel vapor separated from the charcoal 11 for a given time can be great.

During the fuel vapor returning process, the fuel vapor is returned from the canister to the fuel tank 182 via the vapor lines 21 and 186 and the check valve 185. As previously described, the mount of the returned fuel vapor depends on the cross-sectional area of the layer-shaped chambers 101–107 in the canister. In this embodiment, the cross-sectional area of the layer-shaped chambers 101–107 is chosen to enable a sufficiently great amount of the returned fuel vapor. A great amount of the returned fuel vapor results in effective prevention of the leakage of the fuel vapor from the canister via the air inlet 15.

After the fuel vapor absorbing process, the fuel vapor tends to remain in the vapor passage 21 and the vapor inlet 12. Since the layer-shaped chamber 101 is fully filled with the charcoal 11, the remaining fuel vapor is prevented from bypassing the charcoal 11 and moving directly to the purge outlet 134 during the subsequent purging process. In other words, the remaining fuel vapor surely passes through the charcoal 11 before flowing into the engine air induction passage 181. Thus, it is possible to prevent wrong control of the air-to-fuel ratio of the air-fuel mixture which might be caused by the direct transmission of the remaining fuel vapor to the engine air induction passage 181.

While the cross-sectional area of the layer-shaped chambers 101–107 is rectangular in this embodiment, it may be square or circular.

As previously described, all the layer-shaped chambers 101–107 have approximately equal cross-sectional areas in this embodiment. It is preferable that the cross-sectional areas of the layer-shaped chambers 101–107 are equal to or smaller than 40 $cm^2$. It should be noted that only the cross-sectional area of the layer-shaped chamber 101 may be equal to or smaller than 40 $cm^2$.

DESCRIPTION OF THE SECOND PREFERRED EMBODIMENT

Figure 9:
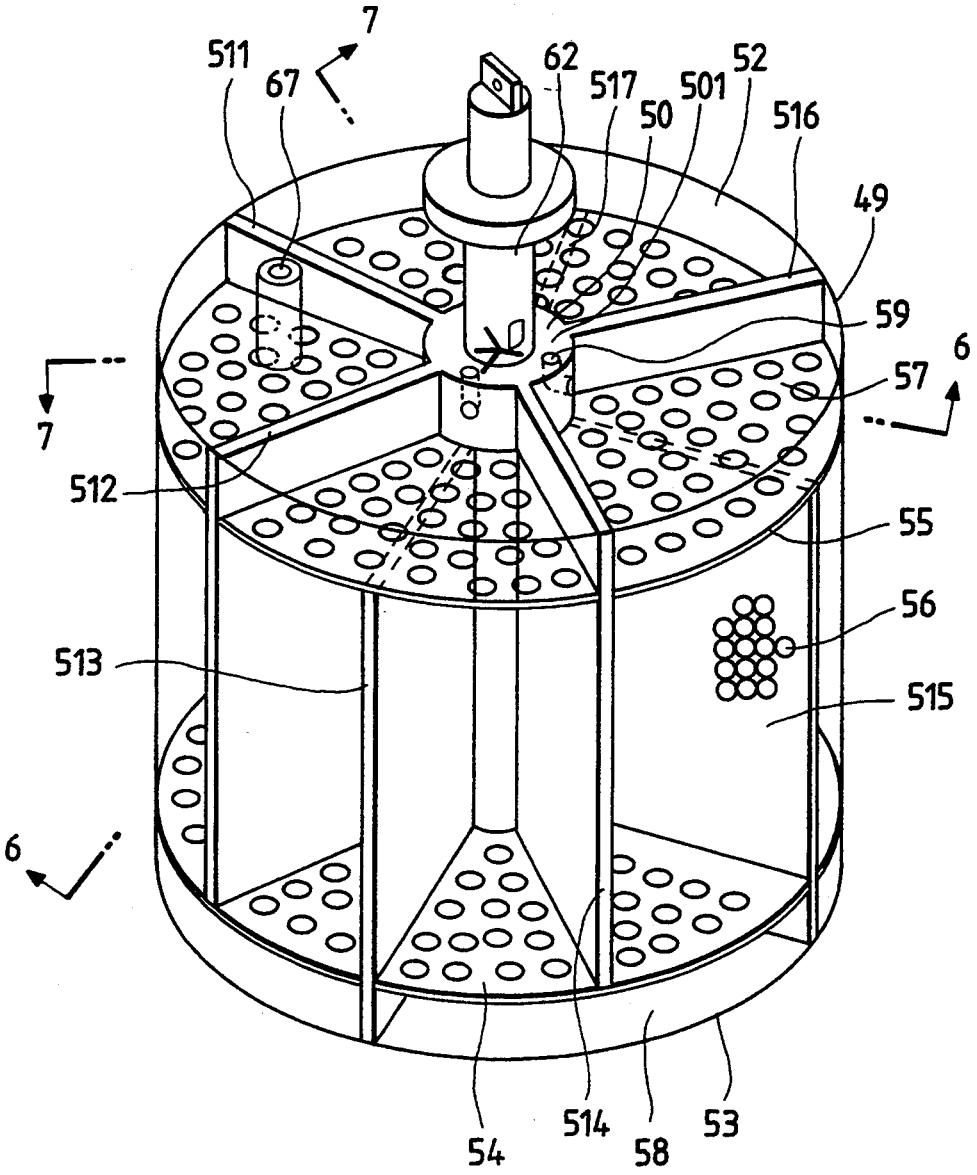
FIG. 9 is a perspective and partially cutaway view of a canister casing in a fuel vapor purging system according to a second embodiment of this invention.
Figure 10:
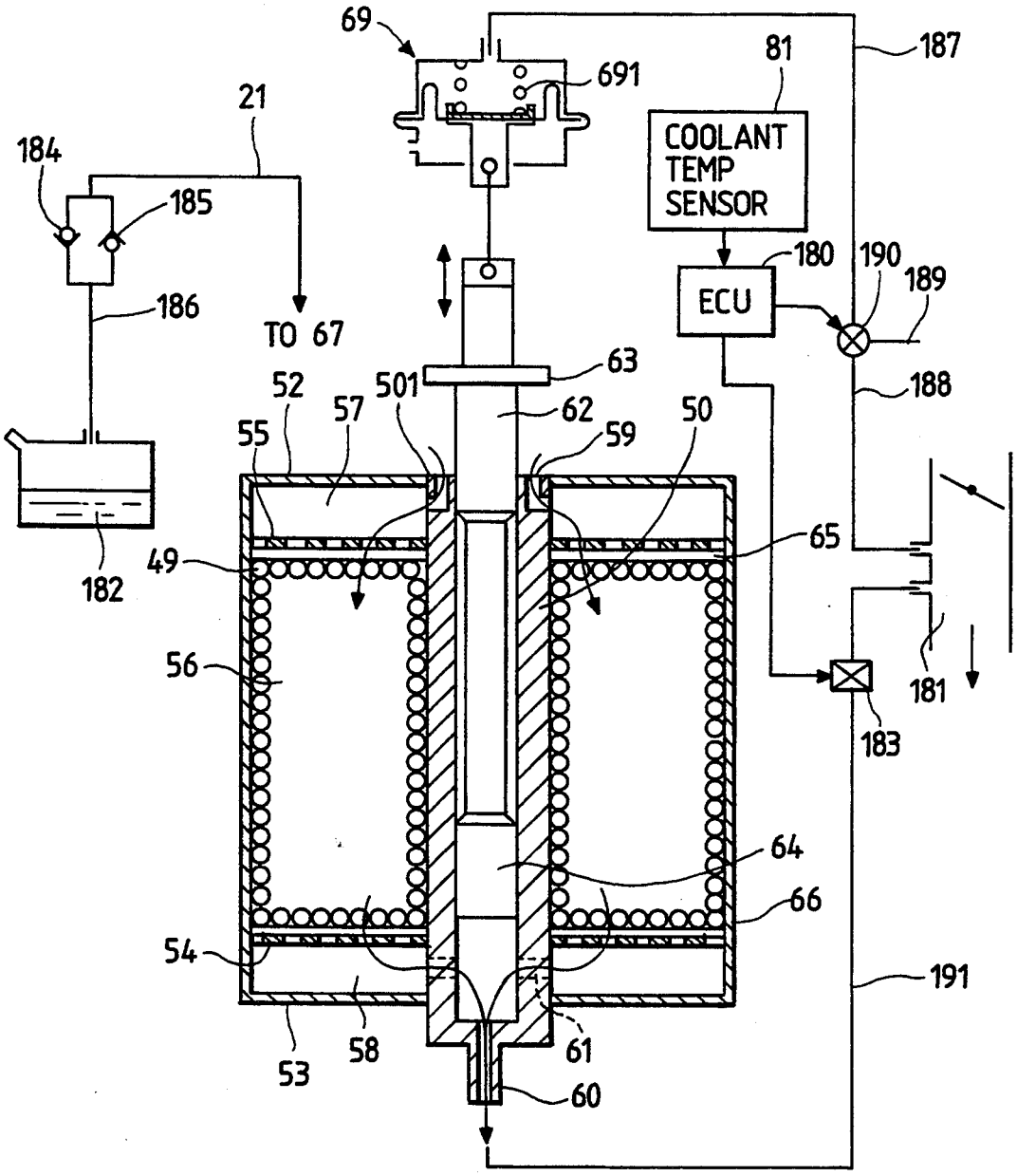
FIG. 10 is a diagram of the fuel vapor purging system in the second embodiment which includes a sectional-view taken along the line 6-0-6 of FIG. 9.
Figure 11:
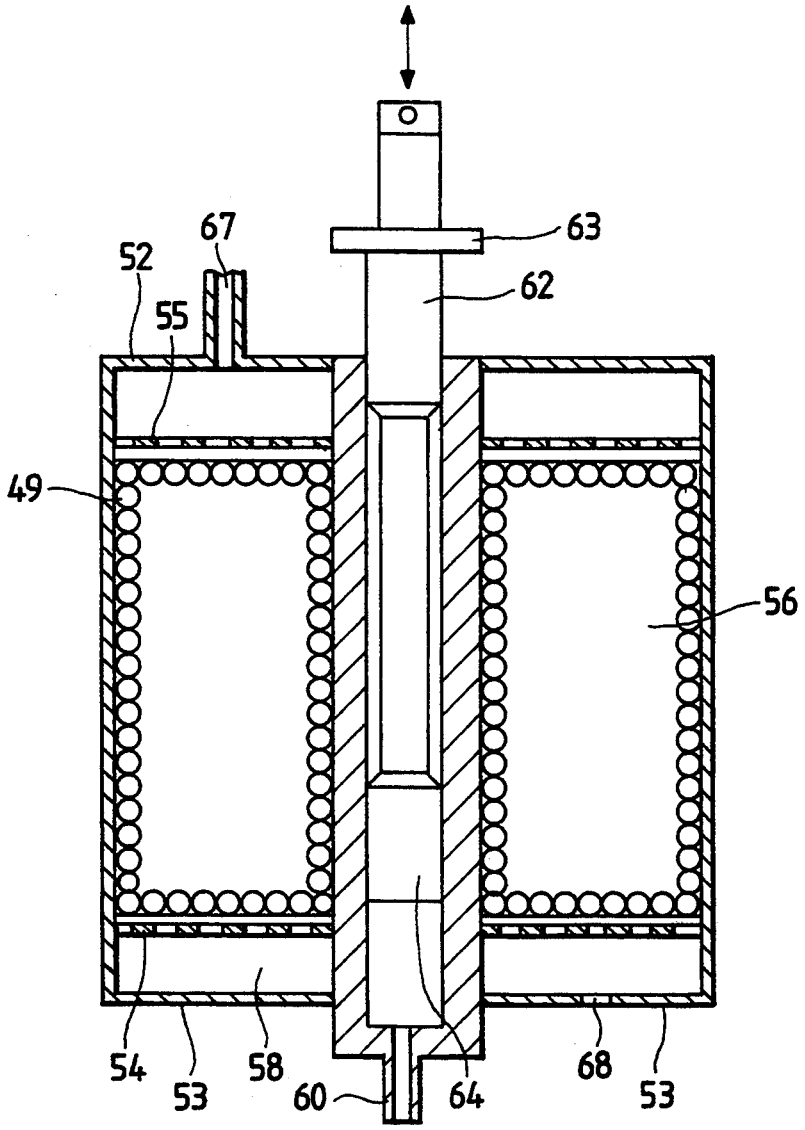
FIG. 11 is a sectional view taken along the line 7-0-7 of FIG. 9.

A second embodiment of this invention is similar to the embodiment of FIGS. 1–8 except for design changes indicated later. The second embodiment will now be described in detail. With reference to FIGS. 9–11, a canister has a cylindrical casing 49. A cylinder 50 provided in the casing 49 extends along the central axis of the casing 49. The cylinder 50 is formed with radially-extending flat fins 511, 512, 513, 514, 516, and 517. The fins 511–517 are partition members which equally divide the interior of the casing 49 into seven chambers. These chambers have cross-sectional areas, at least one of which is equal to or smaller than 40 $cm^2$ as in the embodiment of FIGS. 1–8.

The fin 511 extends between an upper end 52 and a lower end 53 of the casing 49. The fins 512, 514, and 516 extend between the upper end 52 of the casing 49 and a porous plate 54 disposed in a lower region of the casing 49. The fins 513, 515, and 517 extend between the lower end 53 of the casing 49 and a porous plate 55 disposed in an upper region of the casing 49.

The porous plate 54 has four sector sections. The first sector section contacts side surfaces of the fins 511 and 512. The second sector section contacts side surfaces of the fins 512 and 514, and also contacts the upper edge of the fin 513. The third sector section contacts side surfaces of the fins 514 and 516, and also contacts the upper edge of the fin 515. The fourth sector section contacts side surfaces of the fins 511 and 516, and also contacts the upper edge of the fin 517.

The porous plate 55 has four sector sections. The first sector section contacts side surfaces of the fins 511 and 513, and also contacts the lower edge of the fin 512. The second sector section contacts side surfaces of the fins 513 and 515, and also contacts the lower edge of the fin 514. The third sector section contacts side surfaces of the fins 515 and 517, and also contacts the lower edge of the fin 516. The fourth sector section contacts side surfaces of the fins 511 and 517.

Seven divided chambers having sector-shaped cross-sectional areas are defined by the fins 511–517, the porous plates 54 and 55, and the circumferential portion of the casing 49. The cross-sectional area of at least one of the divided chambers is equal to or smaller than 40 $cm^2$ as in the embodiment of FIGS. 1–8. The divided chambers are filled with absorbent 56 such as activated charcoal.

The upper end 52 of the casing 49, the fins 511,512, 514, and 516, the porous plate 55, and the circumferential portion of the casing 49 define communication passages 57. The lower end 53 of the casing 49, the fins 511, 513, 515, and 517, the porous plate 54, and the circumferential portion of the casing 49 define communication passages 58. The communication passages 57 and 58 connect the neighboring divided chambers so that the communication passages 57 and 58 and the divided chambers form a zigzag passage (path) extending alternately upward and downward. The zigzag passage extends circumferentially as viewed from the top of the casing 49.

A top of the cylinder 50 has three canister air inlets 59 for introducing fresh air into the communication passages 57.

A bottom of the cylinder 50 has a canister purge outlet 60 connected via a purge passage 191 to the region of an engine air induction passage 181 downstream of a throttle valve (no reference numeral). In addition, a lower portion of the cylinder 50 has three inner purge passages 61 which are angularly offset from the air inlets 59 by angular spaces of 51.4° (equal to 360°/7). The inner purge passages 61 open into the communication passages 58. The air inlets 59 are located above the fins 513, 515, and 517 respectively. The inner purge passages 61 are located above the fins 512, 514, and 516 respectively. The inner purge passages 61 can be connected to the purge outlet 60 via an axial bore in the cylinder 50.

The cylinder 50 has the axial bore into which a rod or a valve member 62 slidably extends. The rod 62 is connected to a diaphragm-type actuator 69. An outlet of an electrically-driven three-way valve 190 is connected to the actuator 69 via a passage 187. A first inlet of the three-way valve 190 is connected via a passage 188 to the engine air induction passage 181 downstream of the throttle valve. Thus, the first inlet of the three-way valve 190 is subjected to an air induction vacuum while an engine is operating. A second inlet of the three-way valve 190 opens into the atmosphere via a passage 189. The three-way valve 190 selectively applies the vacuum and the atmospheric pressure to the actuator 69. When the vacuum is applied to the actuator 69, the actuator 69 moves the rod 62 upward against the force of a return spring 691. When the atmospheric pressure is applied to the actuator 69, the actuator 69 moves the rod 62 downward by the force of the return spring 691.

An upper portion of the rod 62 has a flange or a valve ring 63. A lower portion of the rod 62 has a valve member 64. When the rod 62 assumes a lowermost position, the valve ring 63 blocks the air inlets 59 and the valve member 64 blocks the inner purge passages 61. As the rod 62 moves upward from the lowermost position, the air inlets 59 and the inner purge passages 61 are unblocked.

Suitable members 65 and 66 provided between the porous plate 55 and the charcoal 56 and between the porous plate 54 and the charcoal 56 prevent the leakage of the charcoal 56 from the casing 49.

The upper end 52 of the casing 49 between the fins 511 and 512 is provided with a canister vapor inlet 67 formed by a pipe. The vapor inlet 67 leads to the divided chamber within the casing 49 which extends between the fins 511 and 512. The vapor inlet 67 is connected to a fuel tank 182 via vapor lines 21 and 186 and check valves 184 and 185.

The lower end 53 of the casing 49 between the fins 511 and 517 is provided with a canister air inlet 68. The air inlet 68 opens into the atmosphere and communicates with the divided chamber in the casing 49 between the fins 511 and 517.

The three-way valve 190 is controlled in response to a signal fed from an electronic control unit (ECU) 180. A purge control valve 183 including an electrically-driven valve is provided in the purge passage 191. The purge control valve 183 is driven by a signal fed from the ECU 180.

The ECU 180 includes a microcomputer or a similar device which operates in accordance with a program stored in an internal ROM. The program is designed to execute the following operation of the ECU 180.

During suspension of the engine, the ECU 180 outputs a control signal to the three-way valve 190 so that the atmospheric pressure will be applied to the actuator 69. Thus, the rod 62 is held in the lowermost position by the actuator 69, and the air inlets 59 and the purge passages 61 are blocked by the valve members 63 and 64. It is now assumed that the atmospheric temperature rises and thus the pressure within the fuel tank 182 increases during suspension of the engine. When the pressure within the fuel tank 182 exceeds the atmospheric pressure by a predetermined pressure value (equal to, for example, 22 mmHg), the check valve 184 is opened so that fuel vapor flows from the fuel tank 182 into the canister via the vapor lines 186 and 21 and the vapor inlet 67. Specifically, the fuel vapor enters the communication passage 57 via the vapor inlet 67, and passes through the porous plate 55 before flowing into the divided chamber between the fins 511 and 512. Then, the fuel vapor flows in the divided chamber between the fins 511 and 512 while being absorbed by the charcoal 56 therein. Subsequently, the fuel vapor exits from the divided chamber between the fins 511 and 512, passing through the porous plate 54 and flowing into the communication passage 58. The fuel vapor moves through the communication passage 58 and passes through the porous plate 54, and then enters the divided chamber between the fins 512 and 513. Then, the fuel vapor flows in the divided chamber between the fins 512 and 513 while being absorbed by the charcoal 56 therein. Subsequently, the fuel vapor exits from the divided chamber between the fins 512 and 513, passing through the porous plate 55 and flowing into the communication passage 57. The fuel vapor moves through the communication passage 57 and passes through the porous plate 55, and then enters the divided chamber between the fins 513 and 514. Then, the fuel vapor flows in the divided chamber between the fins 513 and 514 while being absorbed by the charcoal 56 therein. Subsequently, the fuel vapor exits from the divided chamber between the fins 513 and 514, passing through the porous plate 54 and flowing into the communication passage 58. The fuel vapor moves through the communication passage 58 and passes through the porous plate 54, and then enters the divided chamber between the fins 514 and 515. Then, the fuel vapor flows in the divided chamber between the fins 514 and 515 while being absorbed by the charcoal 56 therein. Subsequently, the fuel vapor exits from the divided chamber between the fins 514 and 515, passing through the porous plate 55 and flowing into the communication passage 57. The fuel vapor moves through the communication passage 57 and passes through the porous plate 55, and then enters the divided chamber between the fins 515 and 516. Then, the fuel vapor flows in the divided chamber between the fins 515 and 516 while being absorbed by the charcoal 56 therein. Subsequently, the fuel vapor exits from the divided chamber between the fins 515 and 516, passing through the porous plate 54 and flowing into the communication passage 58. The fuel vapor moves through the communication passage 58 and passes through the porous plate 54, and then enters the divided chamber between the fins 516 and 517. Then, the fuel vapor flows in the divided chamber between the fins 516 and 517 while being absorbed by the charcoal 56 therein. Subsequently, the fuel vapor exits from the divided chamber between the fins 516 and 517, passing through the porous plate 55 and flowing into the communication passage 57. The fuel vapor moves through the communication passage 57 and passes through the porous plate 55, and then enters the divided chamber between the fins 511 and 517. Then, the fuel vapor flows in the divided chamber between the fins 511 and 517 while being absorbed by the charcoal 56 therein. During these processes, air can escape from the interior of the casing 49 via the air inlet 68.

During operation of the engine, the ECU 180 outputs a control signal to the three-way valve 190 so that the vacuum will be applied to the actuator 69. In addition, the ECU 180 outputs a drive signal to the purge control valve 183 to open the latter. Thus, the rod 62 is held in the uppermost position by the actuator 69, and the air inlets 59 and the purge passages 61 are unblocked. When the purge passages 61 are unblocked, a negative pressure (that is, an engine air induction vacuum) is applied to the divided chambers within the canister. As a result of the application of the vacuum, fuel vapor is separated from the charcoal 56 in the canister and is then purged into the engine air induction passage 181 via the purge passages 61 and 191 and the purge outlet 60. In addition, since the air inlets 59 are unblocked, fresh air is introduced into the divided chambers within the canister. The fresh air flows through the charcoal 56 in the divided chambers while promoting the separation of the fuel vapor from the charcoal 56. The fresh air exits from the divided chambers within the canister via the purge passages 61, and then flows from the canister via the purge outlet 60 before being drawn into the engine air induction passage 181 together with the fuel vapor.

It should be noted that the interior of the casing 49 may be unequally divided into seven chambers.

DESCRIPTION OF THE THIRD PREFERRED EMBODIMENT

Figure 12:
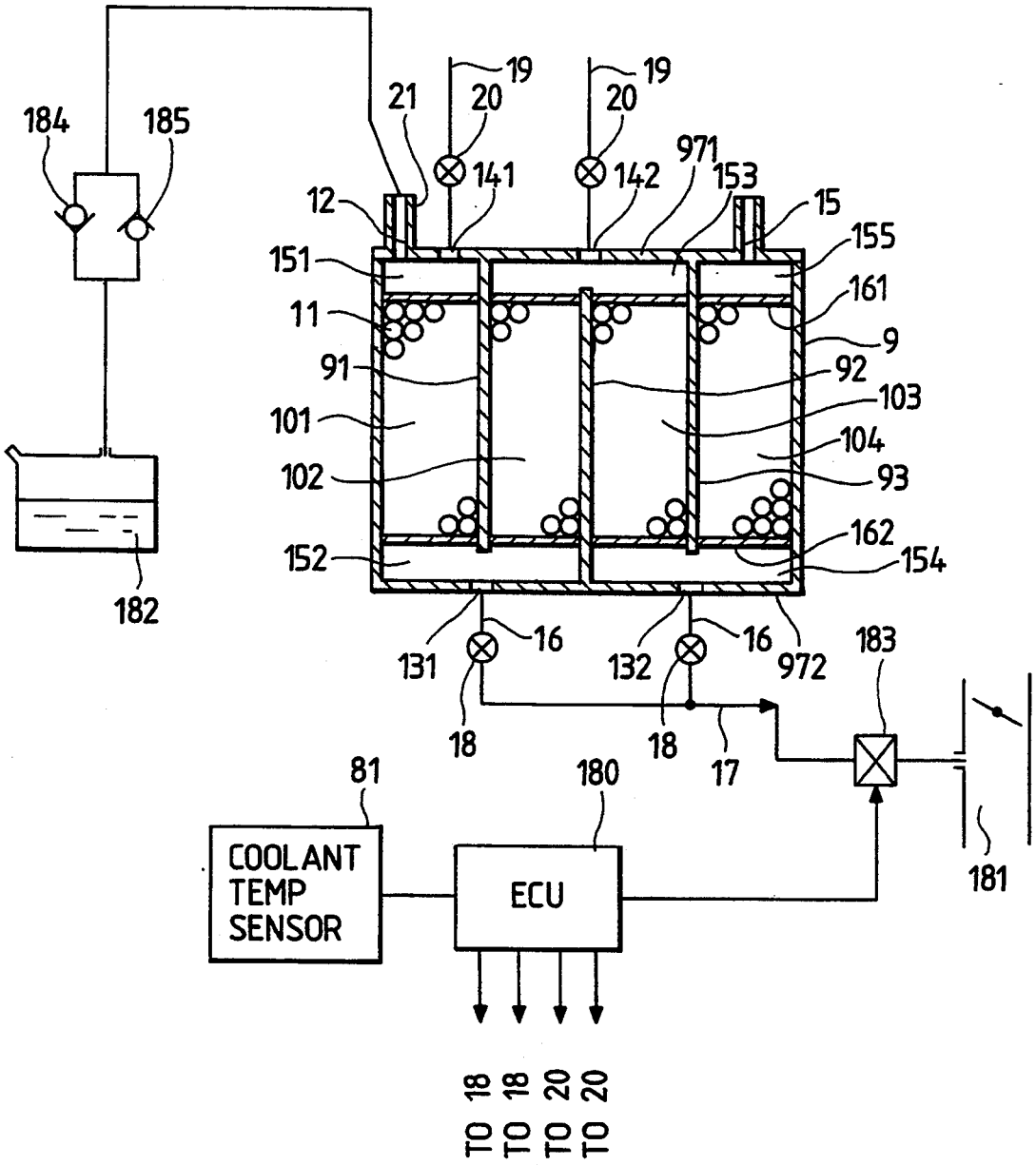
FIG. 12 is a diagram of a fuel vapor purging system according to a third embodiment of this invention.

FIG. 12 shows a third embodiment of this invention which is similar to the embodiment of FIGS. 1–8 except for design changes indicated hereinafter. In the embodiment of FIG. 12, a porous flat plate or a dust-trapping filter 161 disposed within a canister casing 9 extends in parallel to an upper portion 971 of the casing 9. The flat plate 161 is spaced from the upper portion 971 of the casing 9 by a predetermined distance. In addition, a porous flat plate or a dust-trapping filter 162 disposed within the casing 9 extends in parallel to a lower portion 972 of the casing 9. The flat plate 162 is spaced from the lower portion 972 of the casing 9 by a predetermined distance.

Fins 91 and 93 extend downward from the upper portion 971 of the casing 9. A fin 92 extends upward from the lower portion 972 of the casing 9. The fins 91–93, the flat plates 161 and 162, and sides of the casing 9 define four divided layer-shaped chambers 101, 102, 103, and 104 within the casing 9. The divided chambers 101–104 are filled with absorbent 11 such as activated charcoal.

A communication passage 151 within the casing 9 is defined by the upper portion 971 of the casing 9, the flat plate 161, the fin 91, and the sides of the casing 9. The communication passage 151 extends directly above the divided chamber 101. The communication passage 151 is connected to the divided chamber 101 via apertures in the flat plate 161. A canister vapor inlet 12 opens into the communication passage 151. In addition, a canister air inlet 141 opens into the communication chamber 151.

A communication passage 152 within the casing 9 is defined by the lower portion 972 of the casing 9, the flat plate 162, the fin 92, and the sides of the casing 9. The communication passage 152 extends directly below the divided chambers 101 and 102. The communication passage 152 is connected to the divided chambers 101 and 102 via apertures in the flat plate 162. The divided chambers 101 and 102 communicate with each other via the communication passage 152. A canister purge outlet 131 opens into the communication passage 152.

A communication passage 153 within the casing 9 is defined by the upper portion 971 of the casing 9, the flat plate 161, the fins 91 and 93, and the sides of the casing 9. The communication passage 153 extends directly above the divided chambers 102 and 103. The communication passage 153 is connected to the divided chambers 102 and 103 via apertures in the flat plate 161. The divided chambers 102 and 103 communicate with each other via the communication passage 153. A canister air inlet 142 opens into the communication passage 153.

A communication passage 154 within the casing 9 is defined by the lower portion 972 of the casing 9, the flat plate 162, the fin 92, and the sides of the casing 9. The communication passage 154 extends directly below the divided chambers 103 and 104. The communication passage 154 is connected to the divided chambers 103 and 104 via apertures in the flat plate 162. The divided chambers 103 and 104 communicate with each other via the communication passage 154. A canister purge outlet 132 opens into the communication passage 154.

A communication passage 155 within the casing 9 is defined by the upper portion 971 of the casing 9, the flat plate 161, the fin 93, and the sides of the casing 9. The communication passage 155 extends directly above the divided chamber 104. The communication passage 155 is connected to the divided chamber 104 via apertures in the flat plate 161. A canister air inlet 15 opens into the communication passage 155.

The communication passage 151, the divided chamber 101, the communication passage 152, the divided chamber 102, the communication passage 153, the divided chamber 103, the communication passage 154, the divided chamber 104, and the communication passage 155 are connected in series to form a zigzag passage (path) extending alternately upward and downward.

During suspension of an engine, valves 18 and 20 remain closed in response to control signals fed from an ECU 180. It is now assumed that the atmospheric temperature rises and thus the pressure within a fuel tank 182 increases. When the pressure within the fuel tank 182 exceeds the atmospheric pressure by a predetermined pressure value (equal to, for example, 22 mmHg), a check valve 184 is opened so that fuel vapor flows from the fuel tank 182 into the canister via the vapor inlet 12. Then, the fuel vapor successively flows in the communication passage 151, the divided chamber 101, the communication passage 152, the divided chamber 102, the communication passage 153, the divided chamber 103, the communication passage 154, and the divided chamber 104 while being absorbed by the charcoal 11 in the divided chambers 101–104. During this process, air can escape from the interior of the canister via the air inlet 15.

During operation of the engine, the valves 18 and 20 are opened in response to control signals fed from the ECU 180. Thus, a negative pressure (that is, an engine air induction vacuum) is supplied from an engine air induction passage 181 to the divided chambers 101–104 within the canister via purge passages 16 and 17, the purge outlets 131 and 132, and the communication passages 152 and 154. As a result of the supply of the vacuum, fuel vapor is separated from the charcoal 11 in the divided chambers 101–104 and is then purged into the engine air induction passage 181 via the communication passages 152 and 154, the purge outlets 131 and 132, and the purge passages 16 and 17. In addition, fresh air is introduced into the canister via the air inlets 15, 141, and 142. Then, the fresh air passes through the communication passages 151, 153, and 155 and enters the divided chambers 101–104. The fresh air flows through the charcoal 11 in the divided chambers 101–104 while promoting the separation of the fuel vapor from the charcoal 11. The fresh air exits from the divided chambers 101–104, and then enters the communication passages 152 and 154. The fresh air passes through the communication passages 152 and 154, and then flows from the canister via the purge outlets 131 and 132 before being drawn into the engine air induction passage 181 together with the fuel vapor.

DESCRIPTION OF THE FOURTH PREFERRED EMBODIMENT

A fourth embodiment of this invention is similar to the embodiment of FIGS. 1–8 except for design changes indicated later. The fourth embodiment will now be described in detail.

Figure 13:
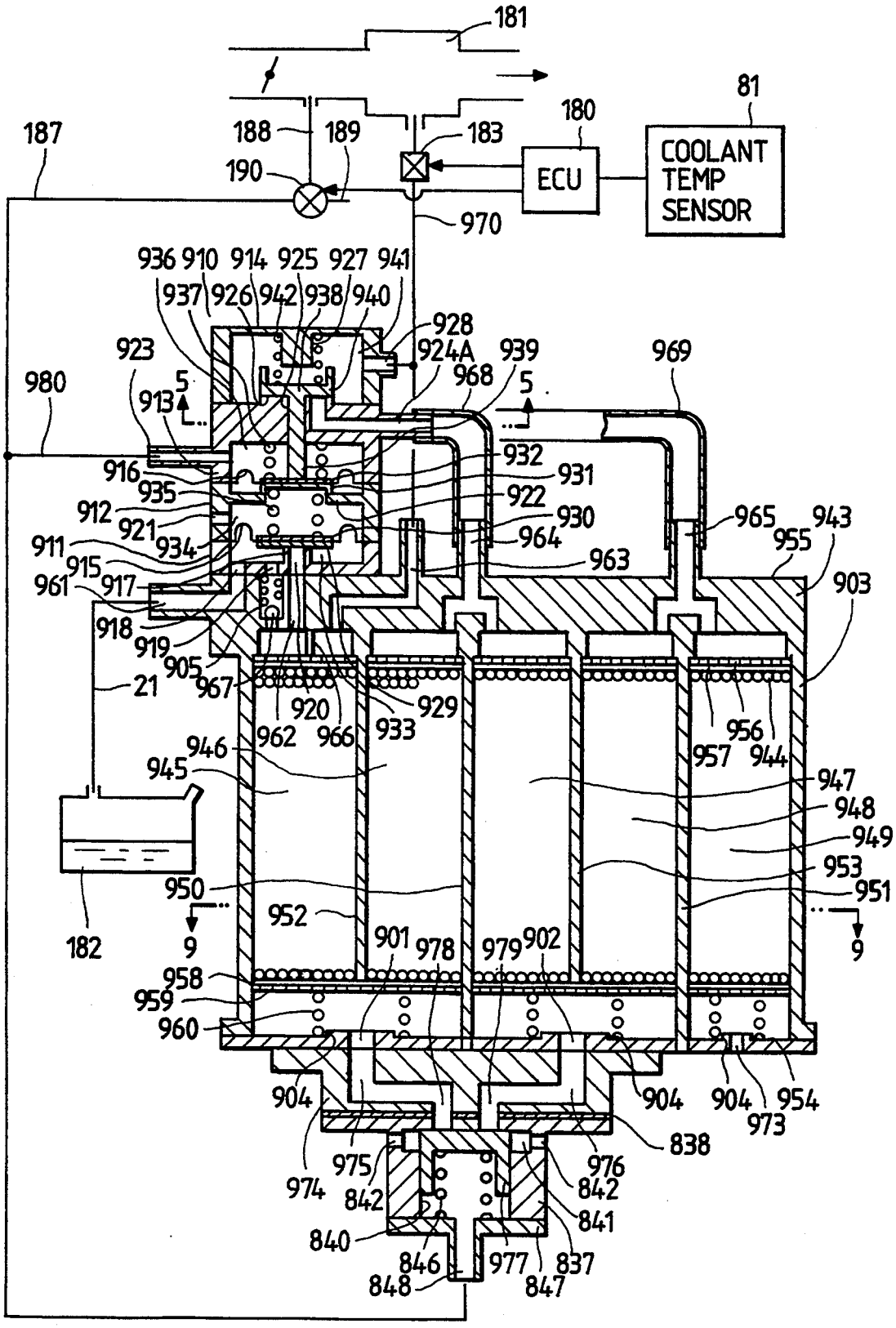
FIG. 13 is a diagram of a fuel vapor purging system according to a fourth embodiment of this invention which includes a sectional view of a canister.
Figure 14:
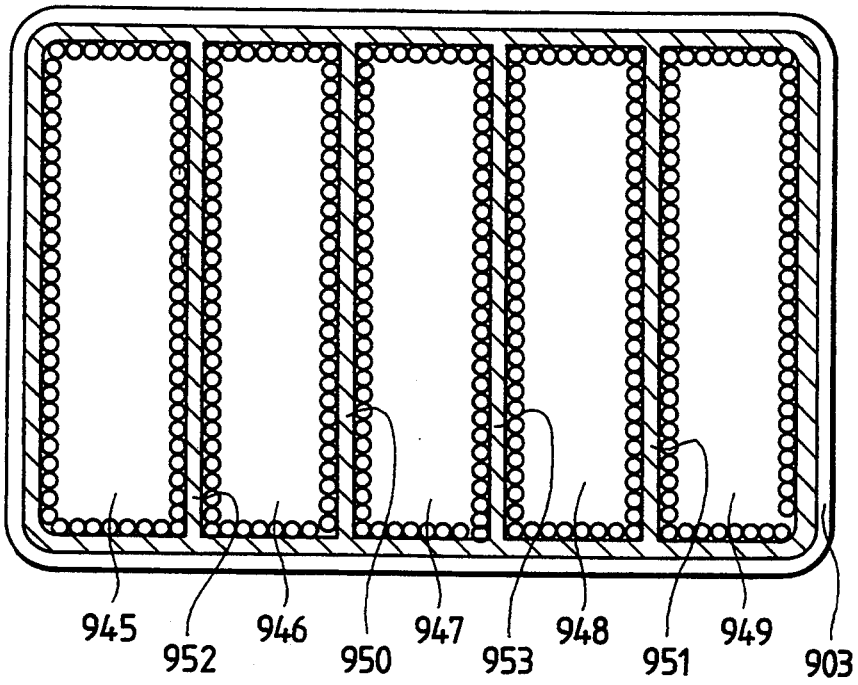
FIG. 14 is a sectional view taken along the line 9—9 of FIG. 13.
Figure 15:
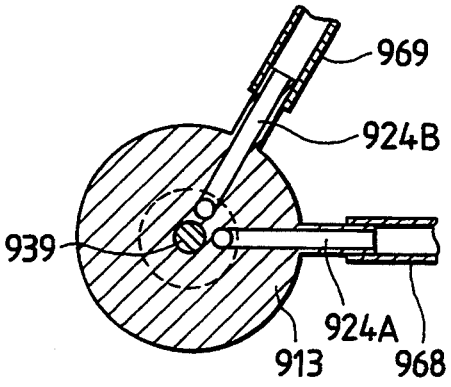
FIG. 15 is a sectional view taken along the line 5—5 of FIG. 13.

With reference to FIGS. 13–15, a pressure setting valve 910 includes a lower body 911, a central body 912, an upper body 913, and a cap 914 which are sequentially stacked. A first diaphragm 915 is provided between the lower body 911 and the central body 912. A second diaphragm 916 is provided between the central body 912 and the upper body 913.

A central portion of the lower body 911 has a valve seat 917. The lower body 911 has three vapor passages 918, 919, and 920. The central body 912 is formed with an inwardly-projecting stopper 922. In addition, the central body 912 has an aperture 921 which opens into the atmosphere. The upper body 913 has a vacuum introduction passage 923, a purge passage 924A, a purge passage 924B, a cylinder 925, and a valve seat 926. A central portion of the cap 914 has a stopper guide 927. In addition, the cap 914 is provided with a purge outlet 928.

A sealing member 929 is provided on a central region of the lower surface of the first diaphragm 915. A sealing member 930 is provided on a central region of the upper surface of the first diaphragm 915. The sealing members 929 and 930 are fixed to each other. The sealing member 929 and 930 may be integral with each other.

A spring seat 931 is formed on a central region of the lower surface of the second diaphragm 916. A spring seat 932 is formed on a central region of the upper surface of the second diaphragm 916. The spring seats 931 and 932 are fixed to each other. The spring seats 931 and 932 may be integral with each other.

A vapor inlet space 933 is defined by the lower body 911 and the first diaphragm 915. A spring chamber 934 is defined by the first diaphragm 915, the central body 912, and the second diaphragm 916. A vacuum introduction chamber 936 is defined by the second diaphragm 916 and the upper body 913. An inner space 941 is defined by the upper body 913 and the cap 914.

A pressure setting spring 935 extending in the spring chamber 934 is supported between the spring seat 930 on the first diaphragm 915 and the spring seat 931 on the second diaphragm 916. A spring 937 extending in the vacuum introduction chamber 936 is supported between the upper body 913 and the spring seat 932 on the second diaphragm 916. The setting force of the pressure setting spring 935 is weaker than the setting force of the spring 937.

The pressure setting valve 910 includes a valve member 938 formed with a rod 939. The rod 939 slidably extends through the cylinder 925 of the upper body 913. The valve member 938 has a valve section 940. As the valve section 940 moves upward and downward together with the valve member 938, the valve section 940 blocks and unblocks the communication between the purge passages 924A and 924B and the inner space 941. The valve member 938 is urged toward the valve seat 926 by a spring 942.

A canister casing 943 has an upper portion 955, from which four partition walls 950, 951,952, and 953 extend downward. Vertical dimensions of the partition walls 952 and 953 are smaller than vertical dimensions of the partition walls 950 and 951. The casing 943 has a lower portion including a lower plate 954 fixed to lower edges of the partition walls 950 and 951 and lower edges of casing side walls 903.

The partition walls 950–953 divide the interior of the casing 943 into five layer-shaped chambers (divided chambers) 945, 946, 947, 948, and 949. Porous plates 956, filters 957, activated charcoal 944, filters 958, and porous plates 959 are disposed in the divided chambers 945–949 in that order along the downward direction. Springs 960 supported between the porous plates 959 and spring guides 904 on the lower plate 954 serve to locate the porous plates 956, the filters 957, the activated charcoal 944, the filters 958, and the porous plates 959 in good positions.

The upper portion 955 of the casing 943 is provided with a canister vapor inlet 961, a vapor passage 962, a first purge outlet 963, a second purge outlet 964, and a third purge outlet 965. The vapor inlet 961 communicates with the vapor passage 918. The vapor inlet 961 is connected to a fuel tank 182 via a passage 21. The vapor passage 962 communicates with the vapor passage 920 and the divided chamber 945. The first purge outlet 963 communicates with the divided chamber 945. The second purge outlet 964 communicates with the divided chambers 946 and 947. The third purge outlet 965 communicates with the divided chambers 948 and 949. The first purge outlet 963 is connected to a region of an engine air induction passage 181 downstream of a throttle valve (no reference numeral) via a purge line 970 and a purge control valve 183. The purge control valve 183 is controlled in response to a signal fed from an ECU 180. The purge line 970 is also connected to the purge outlet 928. The second purge outlet 964 communicates with the purge passage 924A via a pipe 968. The third purge outlet 965 communicates with the purge passage 924B via a pipe 969.

A space between the lower end of the vapor passage 962 and the porous plate 956 is separated from a space between the lower end of the first purge outlet 963 and the porous plate 956 by a small partition wall 966. A passage 905 which connects the divided chamber 945 and the vapor passage 919 accommodates a check valve 967 which allows only the flow of fluid from the divided chamber 945 toward the fuel tank 182.

The lower plate 954 is provided with air inlets 901,902, and 973. A lower housing 974 fixed to the lower plate 954 extends below the lower plate 954. The lower housing 974 has air passages 975 and 976 leading to the air inlets 901 and 902 respectively.

A valve casing 837 fixed to the lower housing 974 extends below the lower housing 974. A gasket is provided between the valve casing 837 and the lower housing 974. The valve casing 837 has air inlets 842, an annular groove 841, a cylinder 840, and passages 978 and 979. The passages 978 and 979 communicate with the air passages 975 and 976 respectively. A valve member 977 is slidably disposed in the cylinder 840 within the valve casing 837. The valve member 977 can move upward and downward. A spring 846 provided between the valve member 977 and a cap 847 urges the valve member 977 upward. The cap 847 is fixed to the lower end of the valve casing 837. The cap 847 has a vacuum inlet 848 which is connected to the engine air induction passage 181 downstream of the throttle valve via vacuum pipes 187 and 188 and an electrically-driven three-way valve 190.

The vacuum introduction chamber 936 within the pressure setting valve 910 is connected to the vacuum pipe 187 via the passage 923 and a vacuum line 980.

A first inlet of the three-way valve 190 is connected via the vacuum pipe 188 to the engine air induction passage 181 downstream of the throttle valve. A second inlet of the three-way valve 190 opens into the atmosphere via a passage 189. An outlet of the three-way valve 190 is connected to the vacuum pipe 187. The three-way valve 190 selectively supplies an engine air induction vacuum and the atmospheric pressure to the vacuum pipe 187. The three-way valve 190 is, controlled in response to a signal fed from the ECU 180.

During suspension of the engine, the purge control valve 183 remains closed, and the inner space 941 in the cap 914 is subjected to the atmospheric pressure. Thus, the valve member 938 is held in contact with the valve seat 926 by the force of the spring 942. In addition, the vacuum introduction chamber 936 and the vacuum inlet 848 are subjected to the atmospheric pressure via the three-way valve 190. Thus, the second diaphragm 916 is held in contact with the stopper 922 by the force of the spring 937. Since the setting force of the spring 935 is weaker than the setting force of the spring 937, the length of the spring 935 is determined by the position of the second diaphragm 916. In this case, since the second diaphragm 916 is in a position at which the second diaphragm 916 contacts the stopper 922, the first diaphragm 915 contacts the valve seat 917 while receiving the force determined by the length of the spring 935. In addition, the application of the atmospheric pressure to the vacuum inlet 848 causes the valve member 977 to be held in an uppermost position by the force of the spring 846. Therefore, the passages 978 and 979 are blocked, and are moved out of communication with the air inlet 842.

Under these condition, fuel vapor which occurs in the fuel tank 182 flows therefrom to the vapor inlet space 933 via the vapor line 21, the vapor inlet 961, and the vapor passage 918. When the pressure of the fuel vapor exceeds the atmospheric pressure by a predetermined pressure value (equal to, for example, 22 mmHg), the vapor pressure forces the first diaphragm 915 to separate from the valve seat 917 against the force of the spring 935. As a result, the fuel vapor flows from the vapor inlet space 933 to the divided chamber 945 via the vapor passages 920 and 962. Then, the fuel vapor successively flows in the divided chambers 945–949 along the zigzag path while being absorbed by the charcoal 944 therein. During this process, air can escape from the interior of the canister via the air inlet 973.

During suspension of the engine, when the fuel tank 182 cools and a vacuum occurs in the fuel tank 182, the first diaphragm 915 is forced into contact with the valve seat 917 so that the vapor passage 920 is blocked. At the same time, the vacuum opens the check valve 967 and therefore acts on the charcoal 944 in the divided chambers 945–949. As a result, the fuel vapor is separated from the charcoal 944 and is returned to the fuel tank 182 via the check valve 967, the vapor passage 919, the vapor inlet space 933, the vapor passage 918, the vapor inlet 961, and the vapor line 21. During the fuel vapor returning process, air is allowed to enter the canister via the air inlet 973.

During operation of the engine, the purge control valve 183 is opened so that the engine air induction vacuum is applied via the valve 183 to the charcoal 944 in the divided chambers 945–949. As a result, the fuel vapor is separated from the charcoal 944 and is drawn into the engine air induction passage 181. During operation of the engine, the engine air induction vacuum is applied to the vacuum introduction chamber 936 via the three-way valve 190. Thus, the second diaphragm 916 is moved upward against the forces of the springs 937 and 942 so that the valve member 938 is lifted until contacting the stopper guide 927. As a result, the purge outlets 964 and 965 are moved into communication with the purge line 970. In addition, the spring 935 is expanded and hence the force of pushing the first diaphragm 915 downward weakens.

During operation of the engine, the engine air induction vacuum is also applied to the vacuum inlet 848 via the three-way valve 190. The vacuum moves the valve member 977 downward against the force of the spring 846 so that the air inlet 942 communicates with the air passages 975 and 976. As a result, fresh air is introduced into the divided chambers 945 and 946 via the air inlet 842 and the air passage 975. Fresh air is also introduced into the divided chambers 947 and 948 via the air inlet 842 and the air passage 976. Furthermore, fresh air is introduced into the divided chamber 949 via the air inlet 973. The introduced fresh air promotes the separation of the fuel vapor from the charcoal 944. The fresh air exits from the canister via the purge outlets 963, 964, and 965, being drawn into the engine air induction passage 181 together with the fuel vapor.

DESCRIPTION OF THE FIFTH PREFERRED EMBODIMENT

A fifth embodiment of this invention is similar to the embodiment of FIGS. 1–8 except for design changes indicated later. The fifth embodiment will now be described in detail.

Figure 16:
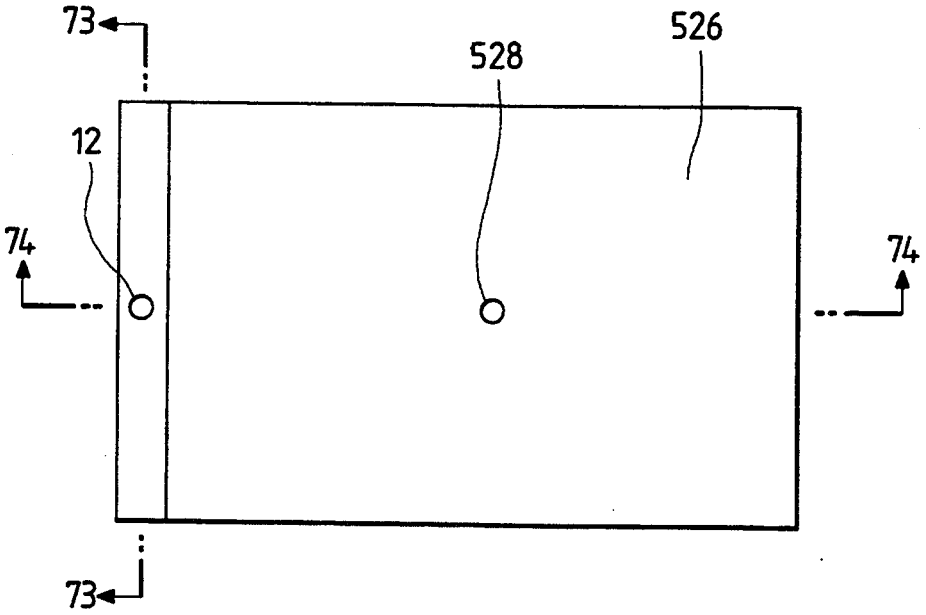
FIG. 16 is a top view of a canister casing in a fuel vapor purging system according to a fifth embodiment of this invention.
Figure 17:
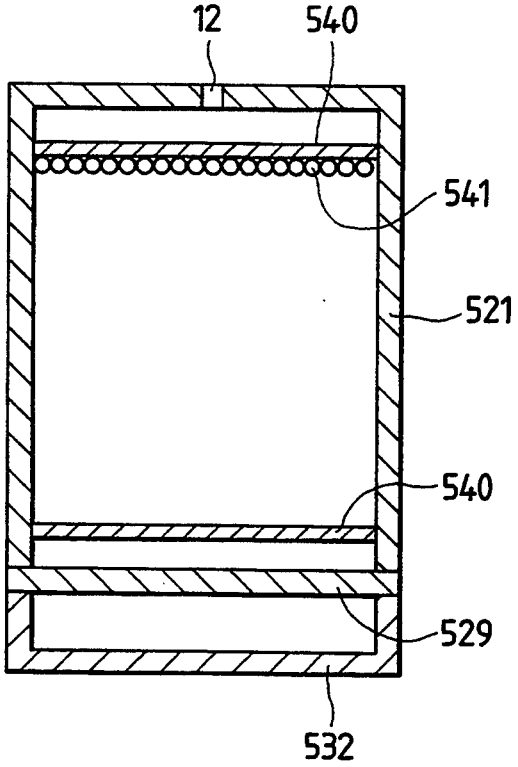
FIG. 17 is a sectional view taken along the line 73—73 of FIG. 16.
Figure 18:
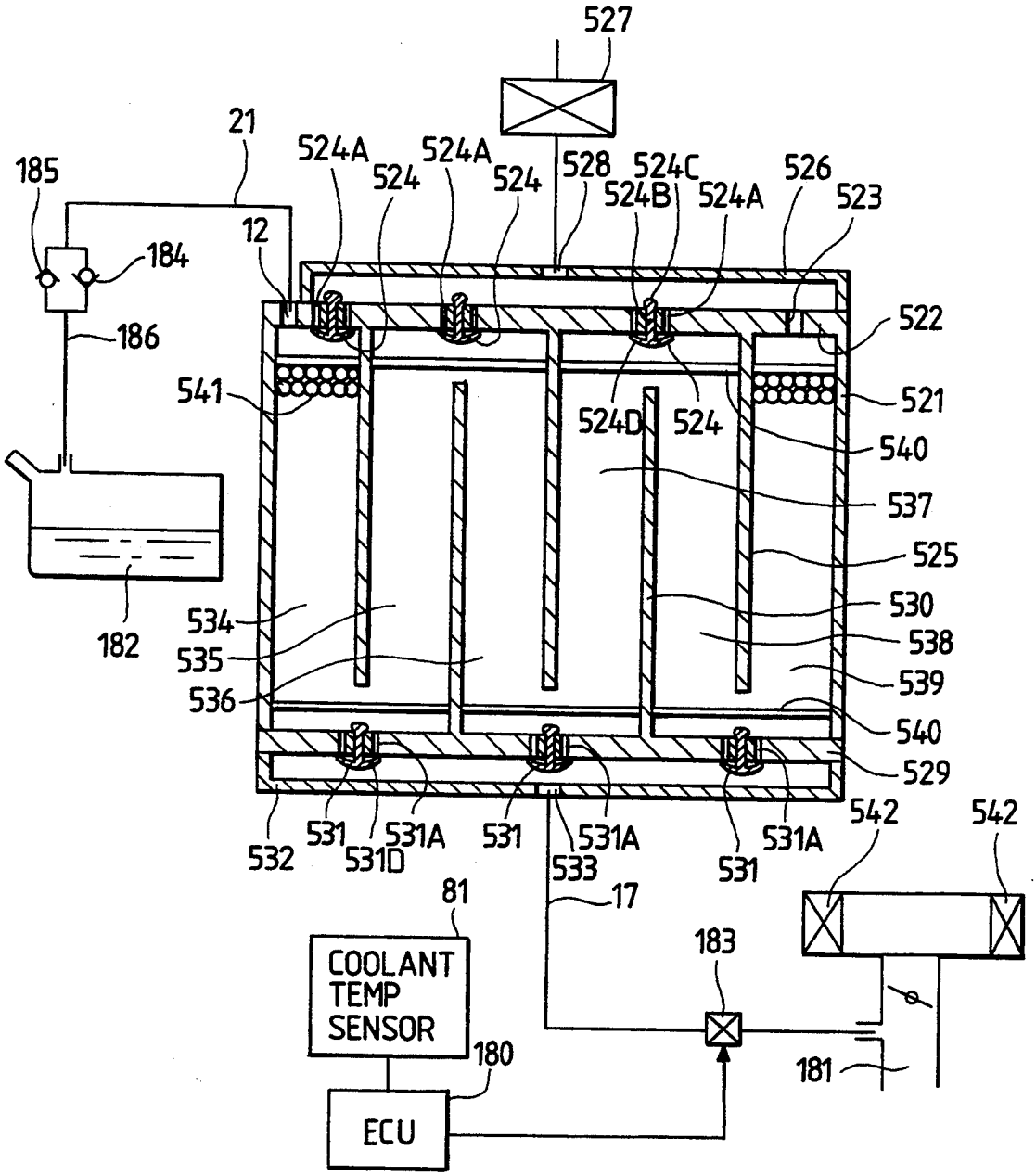
FIG. 18 is a diagram of the fuel vapor purging system in the fifth embodiment which includes a sectional view taken along the line 74—74 of FIG. 16.

With reference to FIGS. 16–18, a canister casing 521 has an upper portion 522 formed with a vapor inlet 12 and an air inlet 523. Three check valves 524 each including a rubber body are provided on the upper portion 522. The body of each check valve 524 is in the form of an umbrella or mushroom, having a bell or pileus portion (a cap portion) 524D, a stem 524B, and a collar 524C. The bell portion 524D and the collar 524C are fixedly provided on opposite ends of the stem 524B respectively. The stem 524B extends through the walls of the upper portion 522. The step 524B is fixed to the upper portion 522 by the collar 524C. The outer edge of the bell portion 524D forms a sealing portion or a valve member. The area of the upper portion 522 between the stem 524B and the outer edge of the bell portion 524D has a plurality of air inlets (valve ports) 524A. Three partition walls 525 extend downward from the upper portion 522.

An upper cover 526 fixed to the upper portion 522 extends above the upper portion 522. The upper cover 526 conceals the air inlet 523 and the check valves 524. A central part of the upper cover 526 has an air inlet 528 which opens into the atmosphere via a filter 527. The air inlet 528 communicates with the air inlet 523 and the valve ports (air inlets) 524A via a space defined within the upper cover 526.

The casing 521 has a lower portion 529. Three check valves 531 each including a rubber body are provided on the lower portion 529. The body of each check valve 531 is in the form of an umbrella or mushroom, having a bell or pileus portion (a cap portion) 531D, a stem 531B, and a collar 531C. The bell portion 531D and the collar 531C are fixedly provided on opposite ends of the stem 531B respectively. The stem 531B extends through the walls of the lower portion 529. The step 531B is fixed to the lower portion 529 by the collar 531C. The outer edge of the bell portion 531D forms a sealing portion or a valve member. The area of the lower portion 529 between the stem 531B and the outer edge of the bell portion 531D has a plurality of purge outlets (valve ports) 531A. Two partition walls 530 extend upward from the lower portion 529.

A lower cover 532 fixed to the lower portion 529 extends below the lower portion 529. The lower cover 532 conceals the check valves 531. A central part of the upper cover 526 has a purge outlet 533 which is connected to a region of an engine air induction passage 181 downstream of a throttle valve (no reference numeral) via a purge passage 17 and a purge control valve 183. An air cleaner 542 is provided at an upstream end of the engine air induction passage 181. The purge control valve 183 is driven by a signal fed from an ECU 180. The purge outlet 533 communicates with the valve ports (purge outlets) 531A via a space defined within the lower cover 532.

The partition walls 525 and 530 divide the interior of the casing 521 into layer-shaped chambers (divided chambers) 534–539 which are arranged to form a zigzag path (passage) extending alternately upward and downward. Absorbent 541 such as activated charcoal is disposed in the divided chambers 535–539. The charcoal 541 is held between suitable members 540 such as porous plates.

During suspension of the engine, the purge control valve 183 remains closed so that the check valves 531 are also closed. It is now assumed that the atmospheric temperature rises and thus the pressure within a fuel tank 182 increases. When the pressure within the fuel tank 182 exceeds the atmospheric pressure by a predetermined pressure value (equal to, for example, 22 mmHg), a check valve 184 is opened so that fuel vapor flows from the fuel tank 182 into the canister via vapor lines 186 and 21 and the vapor inlet 12. Specifically, the fuel vapor enters the divided chamber 534. Then, the fuel vapor successively flows in the divided chambers 534–539 along the zigzag path while being absorbed by the charcoal 541 therein. During this process, air can escape from the interior of the canister via the air inlets 523 and 528 and the filter 527.

During suspension of the engine, when the fuel tank 182 cools and a vacuum occurs in the fuel tank 182, the vacuum opens a check valve 185 and therefore acts on the charcoal 541 in the divided chambers 534–539. As a result, the fuel vapor is separated from the charcoal 541 and is returned to the fuel tank 182 via the vapor inlet 12 and the vapor passages 21 and 186. During the fuel vapor returning process, air is allowed to enter the canister via the filter 527 and the air inlets 528 and 523. In this case, the air inlets 524A usually remains blocked by the check valves 524.

During operation of the engine, the purge control valve 183 is opened by a signal fed from the ECU 180 so that the engine air induction vacuum is applied to the purge outlet 533. The applied vacuum forces the check valves 524 and 531 to be opened. Thus, the vacuum acts on the charcoal 541 in the divided chambers 534–539 and therefore the fuel vapor is separated from the charcoal 541. The fuel vapor is drawn into the engine air induction passage 181 via the check valves 531, the purge outlet 533, and the purge passage 17. During this process, fresh air is introduced into the divided chambers 534–539 via the filter 527, the air inlets 528 and 523, and the check valves 524. The introduced fresh air promotes the separation of the fuel vapor from the charcoal 541. The fresh air exits from the canister via the check valves 531 and the purge outlet 533, being drawn into the engine air induction passage 181 together with the fuel vapor.

In a modification of this embodiment, the filter 527 is removed and the air inlet 528 is connected to a region of the engine air induction passage 181 between the air cleaner 542 and the throttle valve.

What is claimed is:

1. A fuel vapor purging system comprising:

a container having a space formed therein, including:

a plurality of partition members disposed in said space which define a plurality of divided chambers, each said partition member having a communication passage for connecting adjacent divided chambers, each of said divided chambers having opposing first and second ends, said connected divided chambers collectively defining a fuel vapor path having a first end and a second end, absorbent provided in at least some of said divided chambers, a fuel vapor introduction aperture formed in said container adjacent said first end of said fuel vapor, an atmosphere aperture communicating with an atmosphere and formed in a part of the container adjacent said second end of said fuel vapor path, a first opening formed in said container adjacent to said first ends of said divided chambers, and a second opening formed in said container adjacent to said second ends of said divided chambers;

a fuel vapor storing portion located outside of said container;

a fuel vapor passage connecting said fuel vapor introduction aperture and said fuel vapor storing portion;

an atmosphere introduction passage connecting said first opening and the atmosphere;

a fuel vapor drawing portion provided outside said container for drawing fuel vapor thereinto;

a fuel vapor drawing passage connecting said second opening and said fuel vapor drawing portion;

means for selectively opening and closing said atmosphere introduction passage;

means for opening and closing said fuel vapor drawing passage; and control means for operating the atmosphere introduction passage closing and opening means and the fuel vapor drawing passage closing and opening means when fuel vapor is to be absorbed by the absorbent, and for operating the atmosphere introduction passage closing and opening means and the fuel vapor drawing passage closing and opening means when fuel vapor is to be separated from the absorbent;

wherein said communication passages are formed at alternating ends of adjacent divided chambers; and wherein least a first divided chamber along said fuel vapor path has a cross-sectional area equal to or smaller than 40 $cm^2$.

2. The fuel vapor purging system of claim 1, further comprising absorbent provided between the fuel vapor introduction aperture and the divided chamber at the first end of the set of the divided chambers.

3. The fuel vapor purging system of claim 1, further comprising an air chamber between the fuel vapor introduction aperture and the absorbent in the divided chamber at the first end of the set of the divided chambers, a flow passage formed between the air chamber and the second opening, and absorbent provided in the flow passage.

4. The fuel vapor purging system of claim 2 or 3, wherein the atmosphere introduction passage closing and opening means and the fuel vapor drawing passage closing and opening means each comprise a check valve having a resilience and including a stem, a bell portion provided on an end of the stem, and a collar provided on another end of the stem.

5. The fuel vapor purging system of claim 4, wherein the stem is inserted through a stem hole formed in the container, the bell portion includes a resilient member for closing and opening the first opening or the second opening, and the collar has a diameter greater than a diameter of the stem hole.

6. The fuel vapor purging system of claim 5, wherein the bell portion is provided at a side of the fuel vapor drawing portion with respect to the collar, the bell portion opens the first opening or the second opening when being subjected to a vacuum from the fuel vapor drawing portion and thus being attracted by the vacuum, and the bell portion closes the first opening or the second opening by its resilience when an action of the vacuum is absent.

7. The fuel vapor purging system of claim 2 or 3, wherein the atmosphere introduction passage closing and opening means and the fuel vapor drawing passage closing and opening means each comprise an electrically-driven valve, the electrically-driven valve opens the atmosphere introduction passage or the fuel vapor drawing passage when being energized, and the electrically-driven valve closes the atmosphere introduction passage or the fuel vapor drawing passage when being de-energized.

8. The fuel vapor purging system of claim 2 or 3, wherein the atmosphere introduction passage closing and opening means and the fuel vapor drawing passage closing and opening means each comprise a diaphragm and a passage closing and opening member connected to the diaphragm, the passage closing and opening member opens the atmosphere introduction passage or the fuel vapor drawing passage when a vacuum of the fuel vapor drawing portion is applied to the diaphragm, and the passage closing and opening member closes the atmosphere introduction passage or the fuel vapor drawing passage when a vacuum of the fuel vapor drawing portion is not applied to the diaphragm.

9. The fuel vapor purging system of claim 2 or 3, wherein the fuel vapor introduction aperture and the second opening are formed at opposite sides of the container respectively.

10. A fuel vapor purging system comprising:

a container having a space therein;

a plurality of partition members in said space for defining a plurality of divided chambers in the space, said partition members having communication passages for sequentially connecting adjacent chambers of said divided chambers, thereby defining a zigzag path therethrough;

absorbent provided in at least some of said divided chambers;

a fuel vapor introduction aperture formed in said container and connected with a first chamber of said divided chambers;

an atmosphere aperture opening into an atmosphere and formed in a part of said container, said atmosphere aperture being located at one end face of one of said divided chambers different from said first chamber and being in communication with said one divided chamber via a passage;

a fuel vapor drawing portion for drawing fuel vapor, said fuel vapor drawing portion being connected to an intake manifold vacuum and forming a part of the container, said fuel vapor drawing portion being located at one end face of a divided chamber of said divided chambers which is opposite to the atmosphere aperture, said fuel vapor drawing portion being in communication with said divided chamber via a passage;

passage blocking and unblocking means disposed in said passage for communication between said atmosphere aperture and said divided chamber and said passage for communication between said fuel vapor drawing portion and said divided chamber; and control means for actuating said passage blocking and unblocking means to block said passages when said fuel vapor is to be absorbed by said absorbent, and for enabling said passage blocking and unblocking means to unblock said passages when said fuel vapor is to be separated from said absorbent;

wherein at least a first chamber of said divided chambers has a flow-path cross-sectional area equal to or smaller than 40 $cm^2$.

* * * * *

UNITED STATES PATENT AND TRADEMARK OFFICE

CERTIFICATE OF CORRECTION

PATENT NO. : 5,398,660

DATED : March 21, 1995

INVENTOR(S) : KOYAMA et al.

It is certified that error appears in the above-identified patent and that said Letters Patent is hereby corrected as shown below:

On the title page :

Reads: [73] Assignee: Nippondenso Co., Kariya; Nippon Soken Inc., Nishio, Japan

Should Read: [73] Assignee: Nippondenso Co., Ltd., Kariya; Nippon Soken Inc., Nishio, Japan Signed and Sealed this Twenty-fifth Day of July, 1995

*Attest:*

*Attesting Officer*

BRUCE LEHMAN

*Commissioner of Patents and Trademarks*